US010034106B2

(12) United States Patent
van den Berg et al.

(10) Patent No.: US 10,034,106 B2
(45) Date of Patent: Jul. 24, 2018

(54) HEARING AID COMPRISING AN INSERT MEMBER

(71) Applicant: Sonion Nederland B.V., Hoofddorp (NL)

(72) Inventors: Konrad van den Berg, Zoetermeer (NL); Jan Hijman, De Bilt (NL); Thomas A. Cohen-Stuart, Amsterdam (NL); Ewian Vos, Amsterdam (NL); Andrés Alberto Alvarez Cabrera, Delft (NL); Theodorus Geradus Maria Brouwer, Heemstede (NL); Asger Soelberg Andersen, Lille Skensved (DK)

(73) Assignee: Sonlon Nederland B.V., Hoofddorp (NL)

( * ) Notice: Subject to any disclaimer, the term of this patent is extended or adjusted under 35 U.S.C. 154(b) by 0 days.

(21) Appl. No.: 15/079,325

(22) Filed: Mar. 24, 2016

(65) Prior Publication Data

US 2016/0286324 A1 Sep. 29, 2016

(30) Foreign Application Priority Data

Mar. 25, 2015 (EP) ..... 15160806

(51) Int. Cl.
*H04R 25/00* (2006.01)

(52) U.S. Cl.
CPC ..... *H04R 25/654* (2013.01); *H04R 25/608* (2013.01); *H04R 25/65* (2013.01); *H04R 2460/09* (2013.01); *H04R 2460/17* (2013.01)

(58) Field of Classification Search
CPC .... H04R 25/60; H04R 25/65; H04R 2460/17; H04R 2225/023; H04R 2225/025; H04R 1/105; H04R 2225/021; H04R 2225/63
(Continued)

(56) References Cited

U.S. PATENT DOCUMENTS 5,278,360 A 1/1994 Carbe
6,788,796 B1 9/2004 Miles et al.
(Continued)

FOREIGN PATENT DOCUMENTS

DE 4232317 5/1993
EP 0287315 10/1988
(Continued)

OTHER PUBLICATIONS

European Search Report for Application No. EP 15160806, date of completion of the search Sep. 30, 2015 (3 pages).

*Primary Examiner* — Suhan Ni
(74) *Attorney, Agent, or Firm* — Nixon Peabody LLP

(57) ABSTRACT

A hearing aid comprises a housing with a sound channel in a longitudinal direction and terminating in a sound opening, a transducer for transducing sound at the sound opening, and an insert member having an insert part for insertion into the sound channel and a support part arranged against the housing. The insert member forms a sound path from a first sound opening to a second sound opening. The first sound opening is arranged in the insert part and the second sound opening is arranged in the support part outside the sound channel. The insert part comprises a retention member for retaining wax. The retention member includes an opening and is arranged so that a part hereof extends transverse to the longitudinal direction. The support part forms a protruding engagement member which facilitates catching of the insert member without engaging the sound path during removal of the insert member.

19 Claims, 20 Drawing Sheets

(58) Field of Classification Search
USPC ..... 381/322, 328, 330.5, 324–325, 330
See application file for complete search history.

(56) References Cited

U.S. PATENT DOCUMENTS

| | | | | |
|---|---|---|---|---|
| 6,795,562 | B1 * | 9/2004 | Gunnersen | H04R 25/654 381/322 |
| 6,831,577 | B1 | 12/2004 | Furst | |
| 6,853,290 | B2 | 2/2005 | Jorgensen et al. | |
| 6,859,542 | B2 | 2/2005 | Johannsen et al. | |
| 6,888,408 | B2 | 5/2005 | Furst et al. | |
| 6,914,992 | B1 | 7/2005 | van Halteren et al. | |
| 6,919,519 | B2 | 7/2005 | Ravnkilde et al. | |
| 6,930,259 | B1 | 8/2005 | Jorgensen et al. | |
| 6,943,308 | B2 | 9/2005 | Ravnkilde et al. | |
| 6,974,921 | B2 | 12/2005 | Jorgensen et al. | |
| 7,008,271 | B2 | 3/2006 | Jorgensen | |
| 7,012,200 | B2 | 3/2006 | Moller | |
| 7,062,058 | B2 | 6/2006 | Steeman et al. | |
| 7,062,063 | B2 | 6/2006 | Hansen et al. | |
| 7,072,482 | B2 | 7/2006 | Van Doorn et al. | |
| 7,088,839 | B2 | 8/2006 | Geschiere et al. | |
| 7,110,560 | B2 | 9/2006 | Stenberg | |
| 7,136,496 | B2 | 11/2006 | van Halteren et al. | |
| 7,142,682 | B2 | 11/2006 | Mullenbom et al. | |
| 7,181,035 | B2 | 2/2007 | van Halteren et al. | |
| 7,190,803 | B2 | 3/2007 | van Halteren | |
| 7,206,428 | B2 | 4/2007 | Geschiere et al. | |
| 7,221,767 | B2 | 5/2007 | Mullenborn et al. | |
| 7,221,769 | B1 | 5/2007 | Jorgensen | |
| 7,227,968 | B2 | 6/2007 | van Heltren et al. | |
| 7,239,714 | B2 | 7/2007 | de Blok et al. | |
| 7,245,734 | B2 | 7/2007 | Niederdraenk | |
| 7,254,248 | B2 | 8/2007 | Johannsen et al. | |
| 7,286,680 | B2 | 10/2007 | Steeman et al. | |
| 7,292,700 | B1 | 11/2007 | Engbert et al. | |
| 7,292,876 | B2 | 11/2007 | Bosh et al. | |
| 7,336,794 | B2 | 2/2008 | Furst et al. | |
| 7,376,240 | B2 | 5/2008 | Hansen et al. | |
| 7,403,630 | B2 | 7/2008 | Jorgensen et al. | |
| 7,415,121 | B2 | 8/2008 | Mögelin et al. | |
| 7,425,196 | B2 | 9/2008 | Jorgensen et al. | |
| 7,460,681 | B2 | 12/2008 | Geschiere et al. | |
| 7,466,835 | B2 | 12/2008 | Stenberg et al. | |
| 7,492,919 | B2 | 2/2009 | Engbert et al. | |
| 7,548,626 | B2 | 6/2009 | Stenberg et al. | |
| 7,657,048 | B2 | 2/2010 | van Halteren et al. | |
| 7,684,575 | B2 | 3/2010 | van Halteren et al. | |
| 7,706,561 | B2 | 4/2010 | Wilmink et al. | |
| 7,715,583 | B2 | 5/2010 | Van Halteren et al. | |
| 7,728,237 | B2 | 6/2010 | Pedersen et al. | |
| 7,809,151 | B2 | 10/2010 | Van Halteren et al. | |
| 7,822,218 | B2 | 10/2010 | Van Halteren | |
| 7,899,203 | B2 | 3/2011 | Van Halteren et al. | |
| 7,912,240 | B2 | 3/2011 | Madaffari et al. | |
| 7,946,890 | B1 | 5/2011 | Bondo et al. | |
| 7,953,241 | B2 | 5/2011 | Jorgensen et al. | |
| 7,961,899 | B2 | 6/2011 | Van Halteren et al. | |
| 7,970,161 | B2 | 6/2011 | van Halteren | |
| 8,098,854 | B2 | 1/2012 | van Halteren et al. | |
| 8,101,876 | B2 | 1/2012 | Andreasen et al. | |
| 8,103,039 | B2 | 1/2012 | van Halteren et al. | |
| 8,160,290 | B2 | 4/2012 | Jorgensen et al. | |
| 8,170,249 | B2 | 5/2012 | Halteren | |
| 8,189,804 | B2 | 5/2012 | Hruza | |
| 8,189,820 | B2 | 5/2012 | Wang | |
| 8,223,996 | B2 | 7/2012 | Beekman et al. | |
| 8,233,652 | B2 | 7/2012 | Jorgensen et al. | |
| 8,259,963 | B2 | 9/2012 | Stenberg et al. | |
| 8,259,976 | B2 | 9/2012 | van Halteren | |
| 8,259,977 | B2 | 9/2012 | Jorgensen et al. | |
| 8,280,082 | B2 | 10/2012 | van Halteren et al. | |
| 8,284,966 | B2 | 10/2012 | Wilk et al. | |
| 8,313,336 | B2 | 11/2012 | Bondo et al. | |
| 8,315,422 | B2 | 11/2012 | van Halteren et al. | |
| 8,331,595 | B2 | 12/2012 | van Halteren | |
| 8,369,552 | B2 | 2/2013 | Engbert et al. | |
| 8,369,554 | B2 * | 2/2013 | Oberlander | H04R 25/652 381/322 |
| 8,379,899 | B2 | 2/2013 | van Halteren et al. | |
| 8,509,468 | B2 | 8/2013 | van Halteren et al. | |
| 8,526,651 | B2 | 9/2013 | Lafort et al. | |
| 8,526,652 | B2 | 9/2013 | Ambrose et al. | |
| 2008/0019549 | A1 * | 1/2008 | Ochsenbein | H04R 25/654 381/325 |
| 2011/0182453 | A1 | 7/2011 | van Hal et al. | |
| 2011/0189880 | A1 | 8/2011 | Bondo et al. | |
| 2011/0299708 | A1 | 12/2011 | Bondo et al. | |
| 2011/0299712 | A1 * | 12/2011 | Bondo | H04R 25/654 381/325 |
| 2011/0311069 | A1 | 12/2011 | Ambrose et al. | |
| 2012/0014548 | A1 | 1/2012 | van Halteren | |
| 2012/0027245 | A1 | 2/2012 | van Halteren et al. | |
| 2012/0140966 | A1 | 6/2012 | Mocking et al. | |
| 2012/0155683 | A1 | 6/2012 | van Halteren | |
| 2012/0155694 | A1 | 6/2012 | Reeuwijk et al. | |
| 2012/0255805 | A1 | 10/2012 | van Halteren et al. | |
| 2013/0028451 | A1 | 1/2013 | de Roo | |
| 2013/0136284 | A1 | 5/2013 | van Hal et al. | |
| 2013/0142370 | A1 | 6/2013 | Engbert et al. | |
| 2013/0163799 | A1 | 6/2013 | Van Halteren | |
| 2013/0195295 | A1 | 8/2013 | van Halteren et al. | |

FOREIGN PATENT DOCUMENTS

| | | |
|---|---|---|
| EP | 1571882 | 9/2005 |
| EP | 2645742 | 10/2013 |
| EP | 2753100 | 7/2014 |
| JP | 2009/200670 | 9/2009 |
| WO | WO 00/03561 | 1/2000 |

* cited by examiner

HEARING AID COMPRISING AN INSERT MEMBER

CROSS REFERENCE TO RELATED APPLICATIONS

This application claims the benefit of European Patent Application Serial No. EP 15160806.4, filed Mar. 25, 2015, and titled "Hearing Aid Comprising An Insert Member," which is incorporated herein by reference in its entirety.

FIELD OF THE INVENTION

The present invention relates to a hearing aid comprising an insert member, an insert tool for insertion of the insert member into the hearing aid, and a removal tool for removal of the insert member from the hearing aid.

BACKGROUND OF THE INVENTION

Traditionally, an insert member comprising a channel having a passage to allow sound to pass through the insert member is removed by engaging a removal tool at the passage, as this passage provides an easily assessable opening.

However, as ear wax and/or dirt may be present in the insert member, the removal tool may during the removal process press at least a part of the ear wax, dirt or other types of unwanted items into the hearing aid.

An insert member being configured for retention of ear wax and the like may retain a larger portion of ear wax which may make the problem of pressing the unwanted items into the hearing aid even larger.

Prior art document EP 1 571 882 discloses a wax guard and a tool for insertion of a wax guard into a receiver tube of a hearing instrument. The tool grasps the wax guard securely, inserts the wax guard into the tube, and then slides off of the wax guard, leaving the wax guard within the tube.

EP 2 645 742 discloses a transducer protection comprising a top cap, a stem extending from the top cap and having a distal end and a seal at the stem distal ends. The stem protrudes into an opening of a hearing aid component to be protected, when in use. The protection has an outward facing contour that is adapted to match an inner wall of the hearing aid component's opening so that the outer contour of the seal contacts the inner wall of the opening, when in use. Within the seal, at least one sound opening is provided that is surrounded by the seal. The sound opening surrounded by the seal communicates with at least one sound opening along the stem. On the inward facing side of the top cap at least one spacer is provided, that is formed to provide for a gap between the inward facing side of the top cap and an outer surface of a hearing aid component, when in use.

EP 0287 315 discloses an ear wax barrier for a hearing aid. The barrier includes a housing defining a central axis of passage, as well as a plurality of projections. The projections extend inwardly from the interior surface of the housing, each projection partially occluding the cross-sectional area of the housing. The projections define a tortuous path for ear wax migrating into the hearing aid. The barrier can be attached and removed by screwing.

DE 41 32 317 discloses a wax guard system for use with an in-the-ear hearing aid. The wax guard has a housing secured to the hearing aid shell and an insert which is screwed into the housing.

DESCRIPTION OF THE INVENTION

It is an object of embodiments of the invention to provide an improved hearing aid comprising an insert member.

It is a further object of embodiments of the invention to provide a hearing aid which lowers the risk of pressing ear wax into the hearing aid during removal of an insert member. It is an even further object of embodiments of the invention to provide an improved insertion tool and an improved removal tool for insertion and removal of an insert member to and from a hearing aid.

According to a first aspect, the invention provides a hearing aid comprising:

- a housing for positioning in or at an ear canal of a user, the housing having a sound channel extending in a longitudinal direction and terminating in a sound opening;
- a transducer located in the housing and configured for transducing sound at the sound opening,
- an insert member comprising an insert part for insertion into the sound channel and a support part for arrangement against the housing, the insert member forming a sound path from a first sound opening to a second sound opening, the first sound opening being arranged in the insert part and the second sound opening being arranged in the support part outside the sound channel,
- wherein the insert part comprises a retention member for retention of wax, the retention member comprising at least one opening and being arranged so that at least a part hereof extends transverse to the longitudinal direction, and
- wherein the support part forms a protruding engagement member which facilitates catching of the insert member without engaging the sound path during removal of the insert member.

The hearing aid may be a Behind-the-Ear (BTE) device, an In the Ear (ITE) device, a Receiver in the Canal (RIC) device, or any other hearing aid. In the context of the present invention, the term "hearing aid" shall be understood as an electromagnetic device which is adapted to amplify and modulate sound and to output this sound to a user, such as into the ear canal of a user. Furthermore, any type of personal audio devices may also be covered by the term "hearing aid".

Thus, in a specific embodiment, the hearing aid may further comprise a connector housing configured to be connected to a behind-the-ear part of the hearing aid, and an elongated tube configured for transfer of a signal from the connector housing to the housing, wherein the housing and the connector housing are attached to opposite ends of the elongated tube.

The housing is configured for positioning in or at an ear canal of a user. The housing has a sound channel extending in a longitudinal direction and terminates in a sound opening. In one embodiment, the sound channel is formed by a wall of the housing in which an opening is provided, whereby the length of the sound channel may correspond to the thickness of the wall.

In an alternative embodiment, the sound channel is formed by an elongated member extending outwardly from the housing. The elongated member may thus be formed by a spout member.

In a further alternative embodiment, the sound channel is formed by an elongated member extending inwardly into the housing.

It should however be understood that in embodiments where the sound channel is formed by an elongated member extending outwardly from or inwardly into the housing, the wall may also form part of the sound channel.

The sound channel may have a cross-sectional shape being circular. It should however be understood that the cross-sectional shape may also be oval, formed as a square, or have any other shape. The cross-sectional shape and/or size of the sound channel may be non-uniform along the length of the sound channel, as it may change along the length of the sound channel.

Furthermore, it should be understood, that the sound channel may be formed by an elongated member extending both outwardly from and inwardly into the housing.

The transducer located in the housing and configured for transducing sound at the sound opening may comprise a receiver, such as a loudspeaker, or a microphone. Consequently, the sound opening may function as a sound outlet or a sound inlet. It should be understood, that the transducer may comprise both a receiver and a microphone, whereby the sound opening may function both as a sound outlet and a sound inlet.

As ear wax and/or dirt may damage components in the housing when positioned in or at the ear canal of a user, the durability of the hearing air may be increased if the ingress of ear wax and/or dirt info the housing can be reduced or even avoided.

The insert member may be configured for retention of ear wax and/or dirt and may comprising an insert part for insertion into the sound channel and a support part for arrangement against the housing. The support part may further prevent that the insert member is inserted too far into the sound channel.

It should be understood, that the term "retention of wax" in the present context also may include retention of dirt and other unwanted material.

The insert part and the support part may be formed in one piece, e.g. by moulding, such as injection moulding. However, the insert part and the support part may also be formed in as two separate parts which are subsequently attached to each other, e.g. adhesively attached.

The support member may be arranged against an outer surface of the housing when inserted into the sound channel. In one embodiment, the support member may be arranged so that an outer surface of the support member is sealingly arranged against the housing to seal the transition between the support member and the housing. In this way it may be ensured that wax, dirt, and the like do not enter the housing through an opening between the support member and the housing, as the only opening into the housing may be through the sound path.

To avoid that the insert member blocks the sound channel when inserting herein, the insert member may be formed so that sound can pass through the insert member. This may be done by providing an insert member forming a sound path from a first sound opening to a second sound opening, where the first sound opening is arranged in the insert part and the second sound opening is arranged in the support part outside the sound channel. The sound path may extend in the longitudinal direction, so that the first and second sound openings are arranged at opposite ends of the insert member.

The first and second sound openings may have a size being in the range of 5-95 percent of the size of the sound channel, such as 10 percent, 20 percent, 30, 40 50, 60, 70, 80, or 90 percent. It should be understood, that the first and second sound opening may be of the same or of different size and shape.

During use of the hearing aid, the amount of ear wax and/or dirt and the like may increase in the insert member. To improve the hearing aid and to ensure that the ear wax, dirt and the like is not moved into the housing, it may from time to time be an advantage to replace the insert member with a new and unused insert member. This may be done on a regular basis.

As the support part forms a protruding engagement member which facilitates catching of the insert member without engaging the sound path during removal of the insert member, the risk of pressing wax, dirt, and the like further into the housing during removal of the insert member may be considerably minimised or even avoided.

The protruding engagement member may be formed by a first flange extending radially outwardly for arrangement against the housing. The first flange may be sealingly arranged by arranging an engagement surface, such as a lower surface of the first flange against the housing. The sealing may be improved by providing a part of the engagement surface with a shape matching the housing encircling the sound opening.

In the content of the present invention, the term "flange" is understood as an element extending radially from an element. The flange may have a circular shape, but may also be oval, or have any other shape. Furthermore, is should be understood, that the flange need not extend radially along the entire circumference of the element.

As described above, the sound channel may be formed in an elongated member extending outwardly form the housing. To facilitate catching of the insert member, the protruding engagement member may be formed by the support part having a radial dimension being larger than a radial dimension at an outer end of the elongated member. Thus, the first flange may extend beyond the circumference of the elongated member, so that the insert member may be removed by catching the first flange. Thus, a removal tool may engage the first flange instead of engaging the sound path.

Alternatively or additionally, the protruding engagement member may be formed as an extension to the support part. The extension may be an elongated element which as an example may be arch-shape, such as having the shape of a hook, or be bridge-shaped forming an extension which is attached to the support part at both ends. The extension may alternatively be formed as an elongated element of uniform size which terminates in an enlarged body. It should be understood that the extension part may comprises more than one element. In one embodiment, the extension part comprises two elements which may be arranged opposite to each other to form a tunnel-like shape. Consequently, the insert member may be removed by catching the extension, whereby a removal tool may engage this extension instead of engaging the sound path.

In other words, the insert member and a housing portion at the sound opening may form a narrowing portion having at a first position along the longitudinal direction and in a cross section in a plane comprising the longitudinal direction, a first width perpendicular to the longitudinal direction, and at a second position along the longitudinal direction and in a cross section in a plane comprising the longitudinal direction, a second width perpendicular to the longitudinal direction, where the first width is smaller than the second width and the first position closer to the sound opening than the second position.

In order to facilitate use of a removal tool comprising an engagement member with an uneven surface configured to engage the protruding engagement member, the sound channel may define a centre axis extending in a longitudinal direction between the housing and the sound opening, where a first radial dimension of the housing relative to the centre axis, and a second radial dimension of the sound channel relative to the centre axis facilitates arrangement of the sound channel and the housing against a plane surface such that the angle of the centre axis to the plane surface is below 80 degrees, such as below 70 degree, such as below 60 degrees.

To prevent the insert member from falling out of the housing during use of the hearing aid, the insert part may be configured to be retained in the sound channel by friction between an outer surface of the insert part and an inner surface of the sound channel. As an alternative or as a supplement, the insert member may be retained by a mechanical locking, e.g. by an outer protrusion on the insert part being configured to engage an indentation formed at an inner surface of the sound channel. A resilient neck portion at the outer end of the sound channel may likewise be used to retain the insert member. Additionally or alternatively, the insert member may be retained by used of a snap-fit locking, a resilient structure, e.g. a spring in combination with a more rigid element which may engage an indentation in the sound channel. It should be understood that other ways of retaining the insert member may also be employed, such a threading, etc.

As the insert member is very small in order to fit into the sound channel of the housing, it may be an advantage if the outer circumference of the insert member is substantially symmetrically in the longitudinal direction. This may facilitate insertion of the insert member into the housing as the user can insert the insert part hereof into the sound channel without having to rotate it into a correct rotational position relative to the housing.

The sound channel may have a length in the longitudinal direction in the range of 0.5-80 mm. By comparison, the housing may have a length in the longitudinal direction in the range of 6-30 mm, whereas the insert member may have a length in the longitudinal direction in the range of 1-5 mm. The width of the sound channel in a cross-section may be in the range of 0.5-4 mm.

The sound channel may comprise a radially outwardly extending edge forming an outer end. The edge may be formed so that it extends radially along the entire circumference of the sound channel or only along a part of the circumference. In embodiments where the edge is formed along the entire circumference, the edge may form part of a sealing between the housing and the insert member. The edge may be especially advantageous in embodiments where the sound channel is formed by an elongated member extending outwardly from the housing.

To facilitate catching of the insert member, the insert member may comprise a second flanges extending radially outwardly, whereby the support part may be formed by two flanges both extending radially outwardly. It should be understood, that the two flanges may be of different size and shape.

To limit wax ingress through the insert member, the insert part comprises a retention member for retention of wax, dirt, etc. The retention member may decrease the size of the void space inside the insert part and may thus hinder wax in getting though.

To improve the acoustic properties of the insert member, the retention member comprises at least one opening. In the context of the present invention, the term "opening" such be understood as a through-opening; e.g. to allow sound to propagate there through. The opening(s) may be circular, oval, square, or of any arbitrary shape. It should be understood that the opening(s) may have a regular shape and an irregular shape; i.e. with sides and angles of any length and size. In embodiments where the retention member comprises two or more openings, these openings may be of different shape and size. In embodiments where the retention member comprises a plurality of openings, the openings may be even or unevenly distributed in the retention member.

The opening may extend transverse to the longitudinal direction, such as at an angle of 15 degrees, 30, 45, 60, 75 degrees, or another angle relative to the longitudinal direction. In one embodiment, the at least one opening is provided perpendicular to the longitudinal direction. The at least one opening may also be provided parallel to the longitudinal direction. It should be understood, that the retention member may comprise a plurality of opening which need not all extend in the same direction; i.e. one opening may extend transverse to the longitudinal direction whereas another opening may extend in the longitudinal direction or parallel to the longitudinal direction. Two openings both extending transverse to the longitudinal direction may extend at different angles relative to the longitudinal direction.

The retention member comprises a part which is arranged transverse to the longitudinal direction, such as at an angle in the range of 15-70 degrees relative to the longitudinal direction, as this may force the wax to travel through an indirect path through the insert part, whereby the risk of soiling the inner space of the housing is considerably decreased. In one embodiment, the retention member is formed by a single part e.g. by a plate structure. This plate structure with one or more holes may be arranged parallel to or transverse to the longitudinal direction. It should be understood, that transverse to also covers a retention member being arranged perpendicular to the longitudinal direction.

As the retention member may comprise a plurality of parts, one or more of these parts may be arranged transverse to the longitudinal direction, whereas other parts may be arranged parallel to the longitudinal direction. If more parts are arranged transverse to the longitudinal direction, they may be arranged so that they extend at different angles relative to the longitudinal direction.

In one embodiment, the retention member comprises at least two parts being symmetrically arranged in the insert member. Thus, the symmetrically arranged parts may be parallel along at least a part of their extent. Furthermore, the retention member may form a V-shape or parts of the retention member may form a V-shape. It should be understood, that the retention member may comprise both a section where two parts are parallel to each other and another section where two parts form a V-shape.

In another embodiment, the retention member may be substantially disc-shaped and may be arranged substantially perpendicular to the longitudinal direction.

It should be understood that the retention member or a part of the retention member in an alternative embodiment is not provided as a plate-like structure. As an example the retention member may comprise at least a part which is formed as a helical structure and/or parts which together form a staircase-like part. The plate-like structure may be combined with any of the additional mentioned forms thereby forming a retention member comprising different parts of different forms.

To further facilitate retention of wax, the retention member may comprise a membrane. The membrane may have a grid size which may be dependent on the size of the sound channel. Additionally or alternatively, the retention member may comprise a retention part made from a porous material, i.e. a sponge-like part facilitating retention of wax. Furthermore, the retention member may have a three-dimensional geometry such as a honeycomb cell structure or at least a part of the retention member may such a structure.

Additionally or alternatively, the hearing aid may comprise an enclosure to retain wax. The enclosure may be formed as a part of the retention member, or the enclosure may be formed at one side of the retention member so that wax collected by the retention member is retained in an enclosure partially formed by the retention member.

In one embodiment, the support part may be attached to the insert part at the retention member. It should be understood, that "attached to" also covers embodiments where the support part and the retention member is formed in one piece.

The insert part may comprise at least one outwardly extending edge configured to be arranged in contact with an inner surface of the sound channel. The outwardly extending edge(s) may facilitate retention of the insert part in the sound channel; i.e. ensure anchorage of the insert member in the sound channel, e.g. by use of frictional forces. Additionally, the at least one edge may function as a scraper which may remove wax located at the inner surface of the sound channel during removal of the insert member, as the edge(s) may scraped against the inner surface during removal. The outwardly extending edge(s) may further add to the strength of the insert member.

The outwardly extending edge may in one embodiment form a substantially cross-like structure in a plane perpendicular to the longitudinal directions. Alternatively, the outwardly extending edge may form a tubular shape, a rectangular shape, a circular shape, such as formed by one or more discs, a spiral shape, a conical shape, a thread-like shape, or any other shape. It should be understood, that the outwardly extending edge may comprise different sections of different shape, whereby the above mentioned shapes may be combined.

In one embodiment, the support part may be attached to the insert part at the outwardly extending edge. It should be understood, that "attached to" also covers embodiments where the support part and the outwardly extending edge is formed in one piece.

According to a second aspect, the invention provides an insertion tool for insertion of an insert member into a hearing aid, the hearing aid comprising a housing for positioning in or at an ear canal of a user, the housing having a sound channel extending in a longitudinal direction and terminating in a sound opening, and a transducer located in the housing and configured for transducing sound at the sound opening, the insertion tool comprising a holding member to retain the insert member and a guide configured to engage an outer surface of the housing to facilitate alignment of the insert member and the sound channel.

It should be understood, that the insert member and the hearing aid may include the above described elements according to first aspect of the invention. Other aspects of the insert member are described below.

By providing a guide configured to engage an outer surface of the housing, the insertion of a relatively small insert member into the hearing aid also being small may be facilitated, as the guide may limit the relative movement of the insertion tool and the hearing aid.

Due to the relatively small size of the sound channel and the insert member, it may be difficult for the user to insert the insert member into the sound channel, especially if the user is an elderly and/or if the user has impaired mobility and/or impaired eyesight.

The holding member may fit into engagement with insert member so that engagement can be obtained with a tolerance above 2 mm in any directions perpendicular to the longitudinal direction. By this tolerance, it is possible to fit the holding member into engagement with the insert member with low accuracy whereby insertion is facilitated.

The holding member configured to retain the insert member may comprise breakable parts (e.g. holding injection gates), temporary adhesive connections, or mechanical interference/indeterminate-fit connections (e.g. snap-fit connection). Retention should be maintained in first instance to hold the insert member in correct position during the insertion, and later release the insert member when it has been inserted into the sound channel. Thus, when moving the insertion tool and the hearing aid closer to each other, the insert member is maintained in/at the insertion tool, and when subsequently moving the insertion tool away from the hearing aid, the insert member is maintained in the sound channel.

When the holding member comprises breakable parts, the material and/or shape may be chosen to ensure breakage at a predetermined force and to reduce the risk of any remains of the holding member entering the insert member.

As the housing is of a larger size than the sound channel, the insertion tool may assist the user when inserting the insert member, as the user may better be able to control movement of the housing with the aid of the insertion tool comprising a guide configured to engage an outer surface of the housing.

The guide may form a funnel having a size which at the opening is larger than the housing in order to pre-align the housing with the insert member retained in the insertion tool. At the opposite end of the guide the size of the funnel may be smaller to better fit the size and shape of an outer surface portion of the housing, thereby aligning the sound channel with the insert member which may be retained in the insertion tool at a position corresponding to the bottom of the funnel, where the bottom is oppositely arranged relative to the opening of the funnel.

It should be understood, that the funnel forming the guide need not be closed along the entire circumference of the housing when the housing is moved into the guide. Thus, the guide may comprise at least one track having a shape matching a part of an outer surface portion of the housing. As an example, the guide may comprise two tracks facing each other and between which the housing may be guided, as each of the tracks may have a shape matching a left and a right side of the housing, respectively.

To facilitate use of the insertion tool, the at least one track may be detachably attached. Consequently, the track(s) may be replaced, e.g. if worn out or if damaged. Additionally, this provides the ability of using a single insertion tool with different hearing aid, as the track(s) may be replaced with another track of different size and/or shape if it is to be used when inserting an insert member into another hearing aid having a housing of different size and/or shape.

To improve guiding of the housing and to prevent or at least reduce wear on the housing, the track(s) may be made from a material being more elastically deformable than the housing, whereby the track(s) may deform at least slightly during insertion of the insert member.

The insertion tool may further comprise a stop member configured to limit axial movement of the housing relative to the insert tool. The stop member may give tactile guidance to the user indicating that the insert member is correctly inserted, and may promote a safer and more complete insertion of the insert member.

Insertion of the insert member may also be carried out by use of an automatic or semi-automatic insertion tool. Thus, the insertion tool may further comprise an actuating member for automatic insertion of the insert member.

An automatic insertion tool may additionally comprise a feeding mechanism configured to keep a new and unused insert member in ready for insertion.

To keep the housing in place during insertion of the insert member, the insertion tool may further comprise a locking member configured to fix the housing to the insertion tool during insertion of the insert member. The locking member may as an example be hingely connected to the main part of the insertion tool, whereby it can be moved into a fixing position when the housing has been guided into the correct position.

In order to protect the insert member from contamination before use, a protective foil can be placed around part of the insertion tool to create a confined chamber. In addition, the foil can also provide functionality such as further alignment features/guiding surfaces, feedback to the user indicating whether the particular insert member has been used, and whether the insert has been inserted. Additional the foil may include information to the user, such as branding, location of features, and instructions.

To facilitate use of the insertion tool, it may by an advantage if a user can look through at least a part of the insertion tool, as the insertion tool itself may hinder the view to the insert member when attaching the insert member to the insertion tool before insertion into a hearing aid. Thus, the insertion tool may comprise at least one translucent part.

In one embodiment, the insertion tool may form part of a package comprising a plurality of insert members. Thus, the package may comprise a holding member to retain the insert member(s) and a guide configured to engage an outer surface of the housing to facilitate alignment of the insert member and the sound channel.

It should be understood, that a skilled person would readily recognise that any feature described in combination with the first aspect of the invention could also be combined with the second aspect of the invention, and vice versa. The remarks set forth in relation to the first aspect are therefore equally applicable in relation to the second aspect.

According to a third aspect, the invention provides an assembly comprising a hearing aid according to the first aspect of the invention and a removal tool for removal of an insert member from the hearing aid, wherein the removal tool comprises an engagement member having an uneven surface configured to engage the protruding engagement member.

Thus, the hearing aid comprises a housing for positioning in or at an ear canal of a user, the housing having a sound channel extending in a longitudinal direction and terminating in a sound opening and a transducer located in the housing and configured for transducing sound at the sound opening.

As described in detail above, the insert member comprises an insert part for insertion into the sound channel and a support part for arrangement against the housing, the insert member forming a sound path from a first sound opening to a second sound opening, the first sound opening being arranged in the insert part and the second sound opening being arranged in the support part outside the sound channel, wherein the support part forms a protruding engagement member which facilitates catching of the insert member without engaging the sound path during removal of the insert member.

By providing the removal tool with an engagement member having an uneven surface, this surface may engage the protruding engagement member of the insert member whereby removal of the insert without engaging the sound path may be facilitated.

The uneven surface may be provided by at least one protrusion. As an example, a single protrusion may be formed like a wedge which may engage the protruding engagement member. The wedge-like protrusion may engage both a protruding engagement member in the form of a first flange and a protruding engagement member in the form of an arc-shaped elongated member.

Alternatively, the uneven surface may be provided by a plurality of protrusions being evenly arranged thereby forming a brush-like surface. The protrusions may e.g. be made from a plastic material having a sufficient rigidity to engage a protruding engagement member in the form of a first flange and/or a protruding engagement member in the form of an arc-shaped elongated member.

An engagement member comprising a plurality of protrusion has the advantage that the removal may be carried out at more positions and from more directions, as the uneven surface may engage the protruding engagement member under different angles and at different position at the surface.

The protrusions may be arranged at a distance corresponding to a distance between the first and second flange of the insert member to facilitate that one protrusion is inserted in a space between the two flanges to facilitate removal of an insert member comprising two flanges.

It should be understood, that the protrusions may also be unevenly arranged.

In a further alternative, the removal tool comprises a mechanical locking member, such as a snap-fit locking which may be configured to snap the protruding engagement member. As an example, the snap-fit locking may comprise two parts being hingely connected to each other, so that protruding engagement member can be inserted into the locking member when in a first configuration, and where the protruding engagement member is locked when the locking member is in a second connection. The snap-fit locking may be configured for engagement with e.g. a radially outwardly extending flange, an elongated member terminating in an enlarged body, and other protruding engagement members.

The uneven surface may fit into the protruding engagement member so that engagement can be obtained with a tolerance above 2 mm in any directions perpendicular to the uneven surface. By this tolerance, it is possible to fit the uneven surface into engagement with the protruding engagement member with low accuracy whereby removal is facilitated.

The removal tool may be configured for collection and storage of at least one insert member, whereby a used insert member may be collected and stored in an insert member compartment when removed from the hearing aid. The insert member compartment may in one embodiment form part of the removal tool.

To also facilitate insertion of an insert member, the assembly may further comprise an insertion tool according to the second aspect of the invention. In one embodiment, the removal tool and the insertion tool form a single tool configured for both removal and insertion of an insert member.

It should be understood, that a skilled person would readily recognise that any feature described in combination with the first and second aspects of the invention could also be combined with the third aspect of the invention, and vice versa. The remarks set forth in relation to the first and second aspects are therefore equally applicable in relation to the third aspect. It should further be understood, that the insert member according to the first aspect may be substituted by an insert member according to the fourth aspect below.

According to a fourth aspect, the invention provides an insert member configured to the inserted into a hearing aid according to the first aspect of the invention, the insert member comprising an insert part for insertion into the sound channel and a support part for arrangement against the housing, the insert member forming a sound path from a first sound opening to a second sound opening, the first sound opening being arranged in the insert part and the second sound opening being arranged in the support part outside the sound channel, wherein the insert part comprises a retention member arranged transverse to the longitudinal direction in the sound path, and wherein the insert part comprises at least one outwardly extending edge configured to be arranged in contact with an inner surface of the sound channel.

The support part may form a protruding engagement member which facilitates catching of the insert member without engaging the sound path during removal of the insert member from the hearing aid.

In an alternative embodiment, the invention provides an insert member for insertion into a sound channel of a hearing aid, the insert member comprising an insert part for insertion into the sound channel and a support part for arrangement against an outer surface of the hearing aid, the insert member forming a sound path from a first sound opening to a second sound opening, the first sound opening being arranged in the insert part and the second sound opening being arranged in the support part outside the sound channel, wherein the insert part comprises a retention member for retention of wax, the retention member comprising at least one opening, and wherein the support part forms an engagement member which facilitates catching of the insert member without engaging the sound path during removal of the insert member from the hearing aid.

It should be understood, that a skilled person would readily recognise that any feature described in combination with the first, second, and third aspects of the invention could also be combined with the insert member of the fourth aspect of the invention, and vice versa. The remarks set forth in relation to the first, second, and third aspects are therefore equally applicable in relation to the fourth aspect.

Furthermore, it should be understood that the insert member according to the first aspect of the invention may be substituted with one of the embodiments according to the fourth aspect of the invention.

According to a fifth aspect, the invention provides a method of removing an insert member from a hearing aid, the hearing aid comprising a housing for positioning in or at an ear canal of a user, the housing having a sound channel extending in a longitudinal direction and terminating in a sound opening, and a transducer located in the housing and configured for transducing sound at the sound opening, the method comprising the steps of:

providing a removal tool comprising an engagement member having an uneven surface configured for engagement with the insert member inserted in the sound channel, biasing the engagement member towards the housing, so that the engagement member engages the insert member, and moving the removal tool and the housing relative to each other so that the insert member is pulled out of the sound channel.

According to a sixth aspect, the invention provides a method of inserting an insert member into a hearing aid, the hearing aid comprising a housing for positioning in or at an ear canal of a user, the housing having a sound channel extending in a longitudinal direction and terminating in a sound opening, and a transducer located in the housing and configured for transducing sound at the sound opening, the method comprising the steps of:

providing an insertion tool according to the second aspect of the invention, inserting an insert member into a holding member of the insertion tool, inserting the housing into the insertion tool to that a guide engages an outer surface of the housing thereby facilitating alignment of the insert member and the sound channel, moving the insertion tool and the housing relative to each other so that the insert member is inserted into of the sound channel.

It should be understood, that a skilled person would readily recognise that any feature described in combination with the first, second, third, and fourth aspects of the invention could also be combined with the fifth and sixth aspects of the invention, and vice versa. The remarks set forth in relation to the first, second, third, and fourth aspects are therefore equally applicable in relation to the methods of the fifth and sixth aspects.

According to a seventh aspect, the invention provides a package comprising a plurality of insert members according to the fourth aspect, wherein the packages forms an insertion tool according to the second aspect, and a removal tool comprising an engagement member having an uneven surface configured to engage the protruding engagement member.

The package may further comprise a compartment configured for collection and storage of at least one insert member which has been removed from a hearing aid.

It should be understood, that a skilled person would readily recognise that any feature described in combination with the first, second, third, fourth, fifth, and sixth aspects of the invention could also be combined with the seventh aspect of the invention, and vice versa. The remarks set forth in relation to the first to sixth aspects are therefore equally applicable in relation to the package of the seventh aspect.

BRIEF DESCRIPTION OF THE DRAWINGS

Embodiments of the invention will now be further described with reference to the drawings, in which.

DETAILED DESCRIPTION OF THE DRAWINGS

It should be understood that the detailed description and specific examples, while indicating embodiments of the invention, are given by way of illustration only, since various changes and modifications within the spirit and scope of the invention will become apparent to those skilled in the art from this detailed description.

Figure 1A:
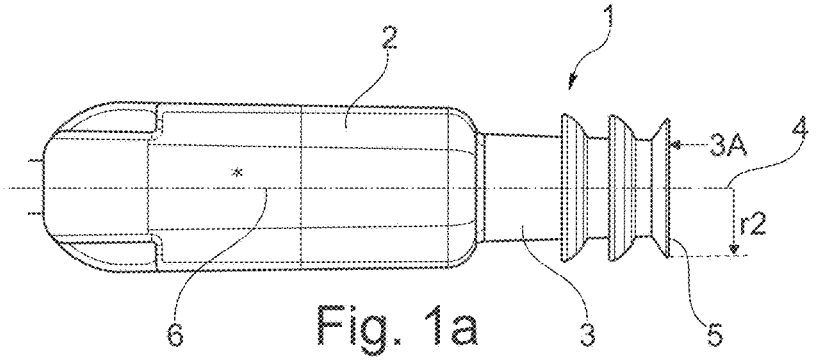
FIG. 1*a* illustrates an embodiment of a housing.

FIG. 1*a* illustrates a hearing aid 1 which comprises a housing 2 configured for positioning in or at an ear canal of a user (not shown). The housing 2 has a sound channel 3 extending in a longitudinal direction illustrated by the dotted line 4 and terminating in a sound opening 5.

In the illustrated embodiment, the sound channel 3 is formed by an elongated member extending outwardly from the housing 2, thereby forming a spout member.

Inside the housing 2, the hearing aid 1 comprises a transducer 6 (indicated by the *) which is configured for transducing sound at the sound opening 5. The transducer 6 may comprise a receiver, such as a loudspeaker, and/or a microphone whereby the sound opening 5 may function as a sound outlet and/or a sound inlet.

The hearing aid 1 further comprises an insert member 7 comprising an insert part 8 for insertion into the sound channel 3 and a support part 9 for arrangement against the housing 2. If the sound channel 3 is formed by an elongated member as illustrated in FIG. 1*a*, the support part 9 is to be arranged against the part of the housing forming an outer end 3A of the elongated member 3.

Figure 1B:
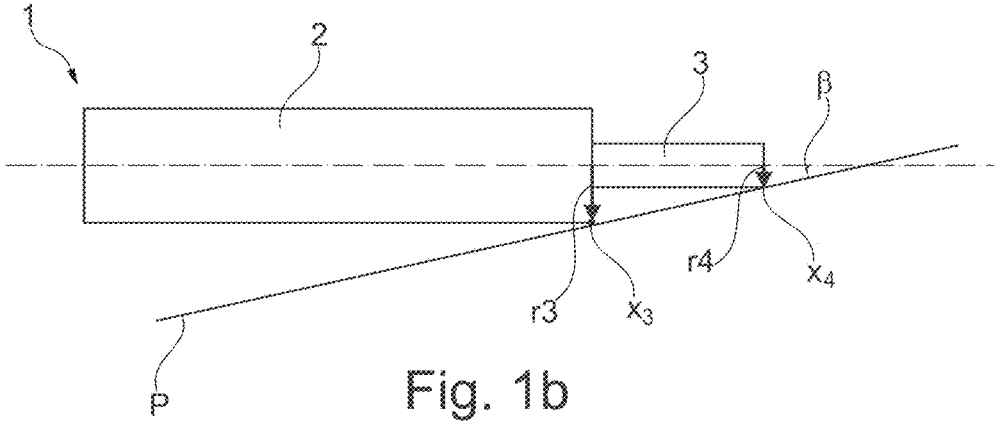
FIG. 1*b* is a sketch illustrating the embodiment of FIG. 1*a*.

FIG. 1*b* is a sketch illustrating the hearing aid 1 as illustrated in FIG. 1*a*. As illustrated in FIG. 1*b*, the housing 2 has a first radial dimension illustrated by the arrow r3, and the sound channel 3 has a second radial dimension illustrated by the arrow r4. The first and second radial dimensions are typically different and they facilitate the illustrated arrangement of the hearing aid 1 against a plane surface P in such a manner that, the housing 2 can be in contact with the plane at the point x3, and the sound channel 3 can be in contact with the plane at the point x4 when the plane forms an angle β to the centre axis of at most 60 degrees. In an alternative embodiment, the angle β to the centre axis is at most 80 degrees, such as at most 70 degrees.

Figure 2A:
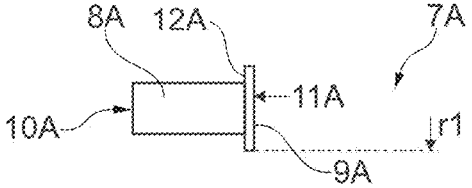
FIG. 2*a* illustrates a first embodiment of an insert member.
Figure 2B:
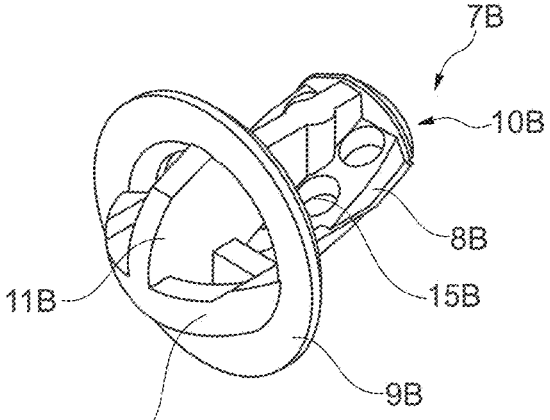
FIG. 2*b* illustrates a second embodiment of the insert member.

FIGS. 2*a* and 2*b* illustrate two different embodiments of an insert member 7A, 7B.

The insert member 7 forms a sound path from a first sound opening 10 to a second sound opening 11, where the first sound opening 10 is arranged in the insert part 8 and the second sound opening 11 is arranged in the support part 9 outside the sound channel 3.

The support part 9 forms a protruding engagement member 12 which facilitates catching of the insert member 7 without engaging the sound path during removal of the insert member 7.

The insert member 7A illustrated in FIG. 2*a* comprises a protruding engagement member 12A in the form of a first flange 12A extending radially outwardly for arrangement against the housing 2. In the illustrated embodiment of the housing 2 (see FIG. 1) the sound channel 3 terminates at the outer end 3A in a radially outwardly extending edge 13. As the protruding engagement member 12A has a radial dimension r1 being larger than the radial dimension r2 of the edge 13, the first flange 12A extends beyond the circumference of the edge 13, so that the insert member 7A can be removed by catching the first flange 12A instead of engaging the sound path.

In the alternative embodiment illustrated in FIG. 2*b*, the protruding engagement member 12B is formed as an extension to the support part 9B. The extension 12B is an elongated element arch-shaped element.

Figure 2C:
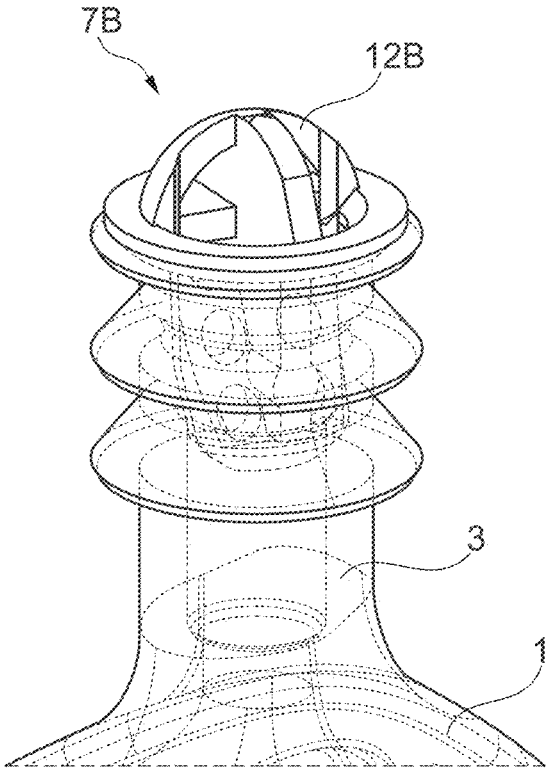
FIG. 2*c* illustrates the insert member of FIG. 2*b* in the sound channel of a hearing aid.
Figure 2D:
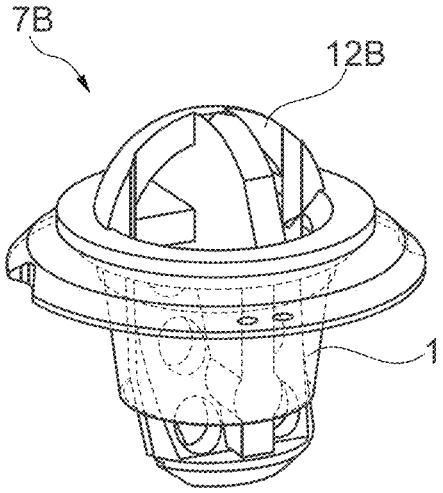
FIG. 2*d* illustrates the insert member in FIG. 2*b* inserted into a hearing aid without a spout member.

FIGS. 2*c* and 2*d* illustrate the insert member of FIG. 2*b* in the sound channel of a hearing aid 1. In FIG. 2*c*, the insert member 7B is inserted into a hearing aid 1 comprising a spout member 3, whereas the insert member 7B in FIG. 2*d* is inserted into a hearing aid 1 without a spout member.

Figure 3A:
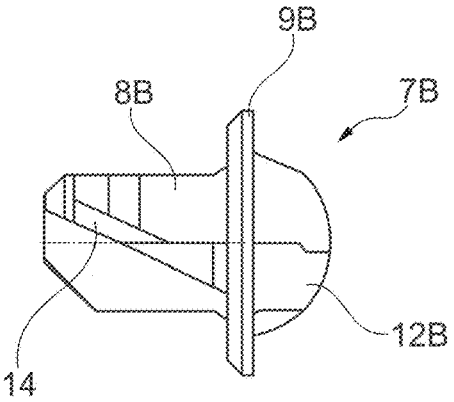
FIG. 3*a* illustrates a side view of the insert member of FIGS. 2*a* and 2*b*.
Figure 3B:
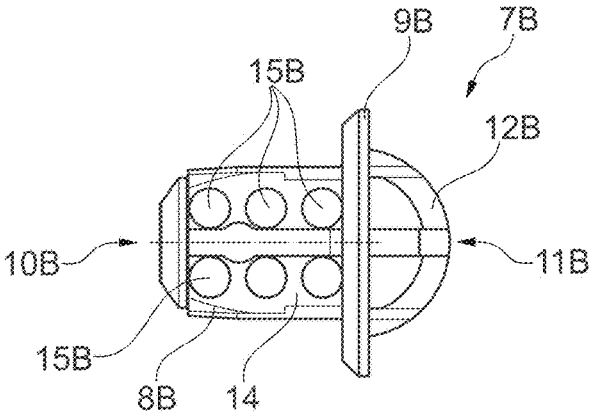
FIG. 3*b* illustrates another view of the insert member of FIGS. 2*a* and 2*b*.
Figure 3C:
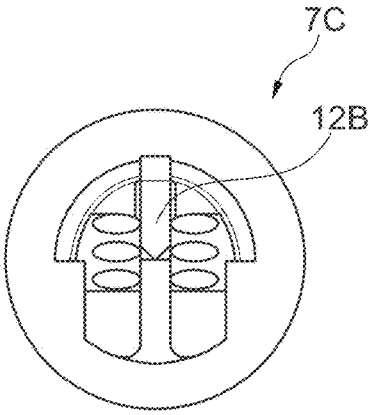
FIG. 3*c* illustrates another embodiment of an insert member.
Figure 3D:
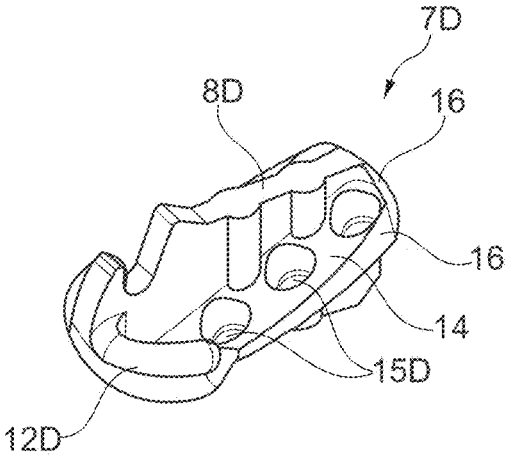
FIG. 3*d* illustrates an additional embodiment of an insert member.
Figure 3E:
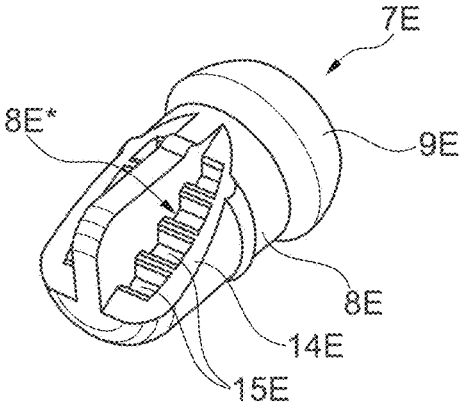
FIG. 3*e* illustrates an additional embodiment of an insert member.
Figure 3F:
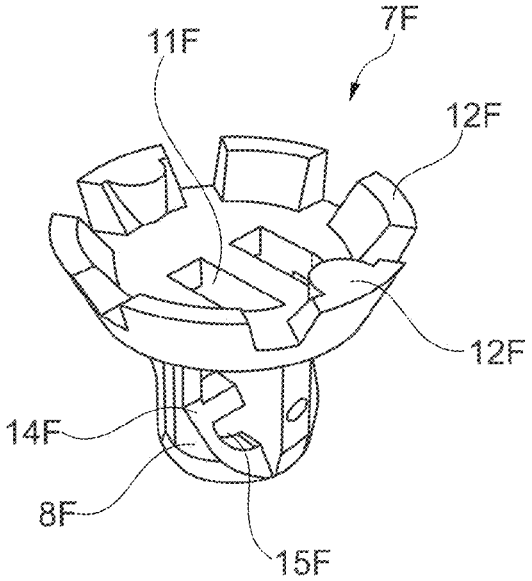
FIG. 3*f* illustrates an additional embodiment of an insert member.
Figure 3G:
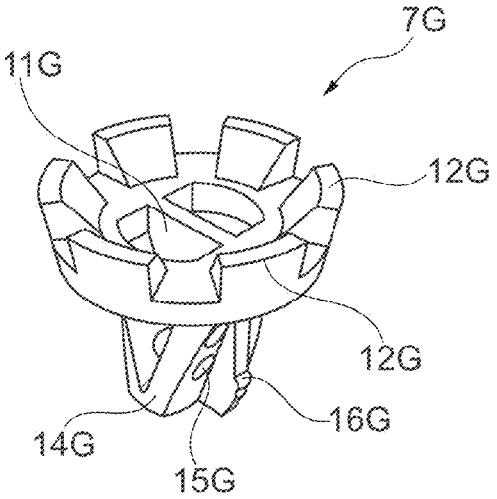
FIG. 3*g* illustrates an additional embodiment of an insert member.
Figure 3H:
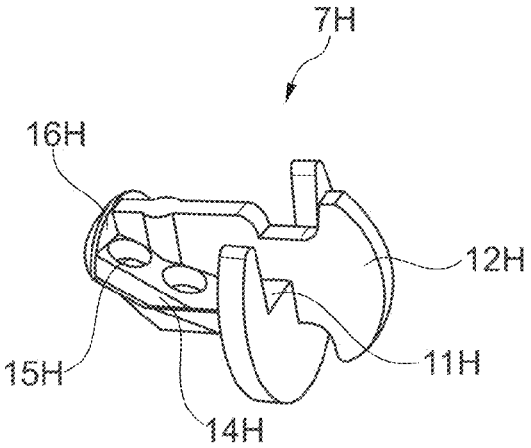
FIG. 3*h* illustrates an additional embodiment of an insert member.
Figure 3I:
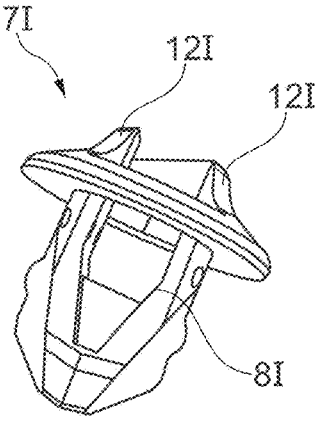
FIG. 3*i* illustrates an additional embodiment of an insert member.
Figure 3J:
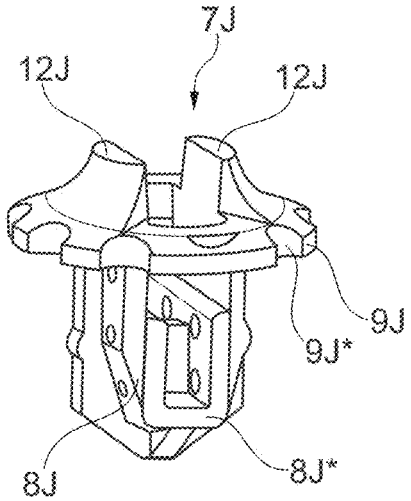
FIG. 3*j* illustrates an additional embodiment of an insert member.
Figure 3K:
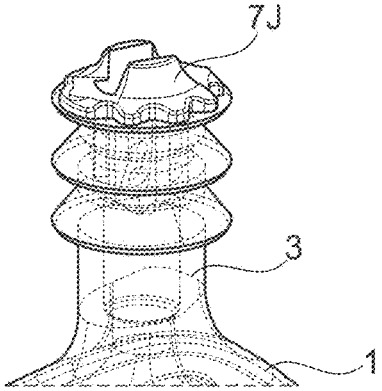
FIG. 3*k* illustrates an additional embodiment of an insert member.
Figure 3L:
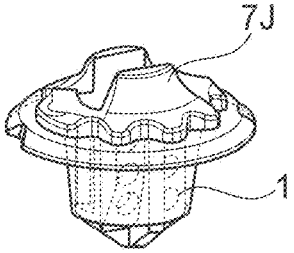
FIG. 3*l* illustrates an additional embodiment of an insert member.
Figure 3M:
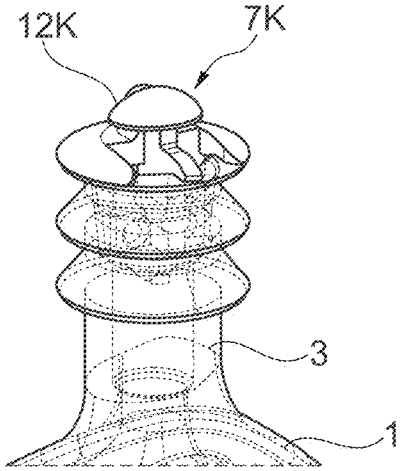
FIG. 3*m* illustrates an additional embodiment of an insert member.
Figure 3N:
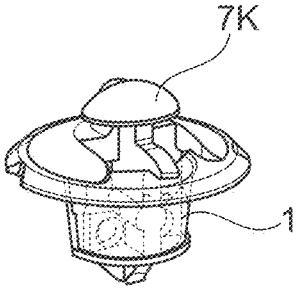
FIG. 3*n* illustrates an additional embodiment of an insert member.
Figure 3O:
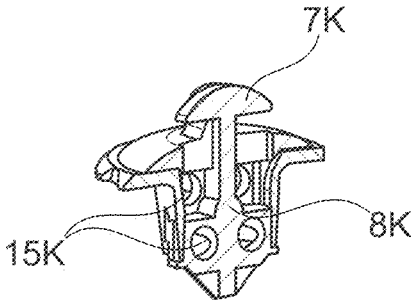
FIG. 3*o* illustrates an additional embodiment of an insert member.
Figure 3P:
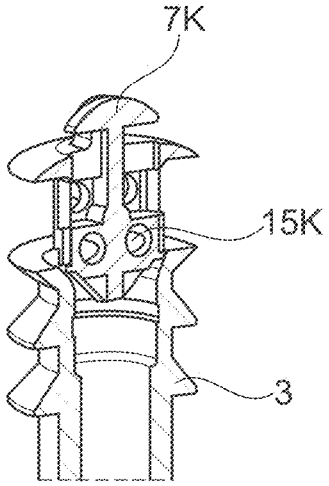
FIG. 3*p* illustrates an additional embodiment of an insert member.
Figure 3Q:
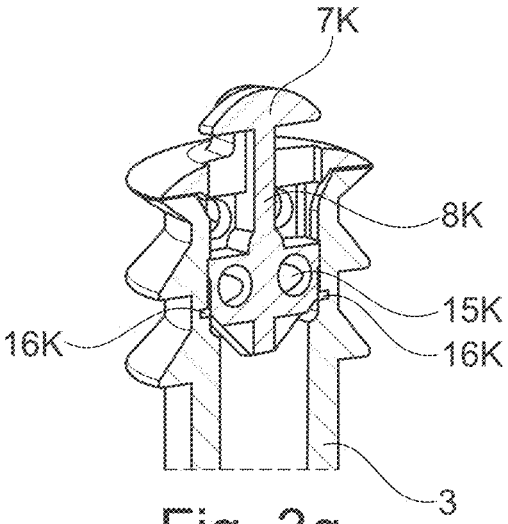
FIG. 3*q* illustrates an additional embodiment of an insert member.
Figure 3R:
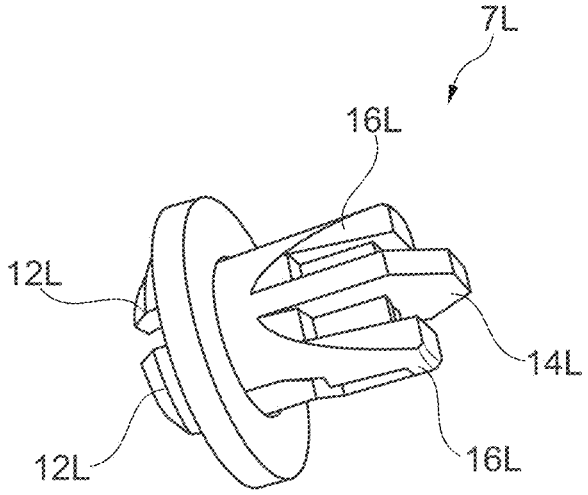
FIG. 3*r* illustrates an additional embodiment of an insert member.
Figure 3S:
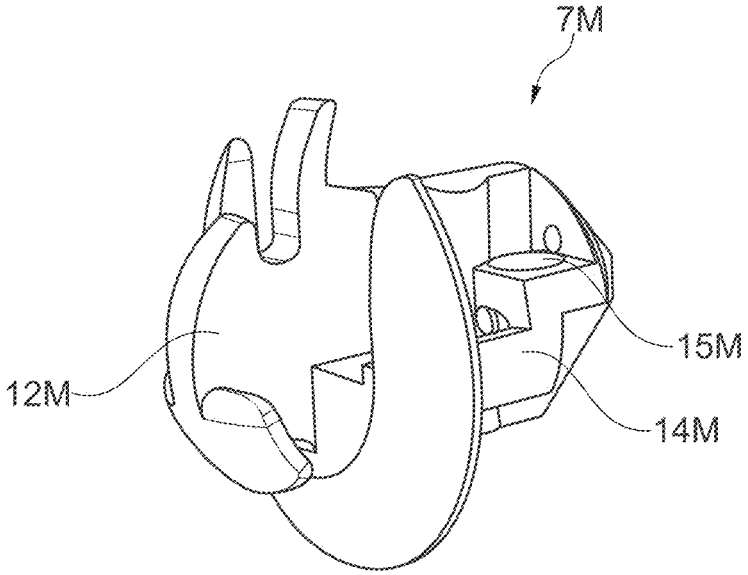
FIG. 3*s* illustrates an additional embodiment of an insert member.
Figure 3T:
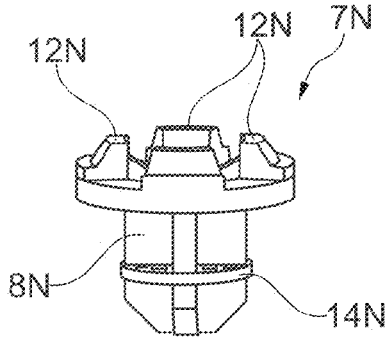
FIG. 3*t* illustrates an additional embodiment of an insert member.
Figure 3U:
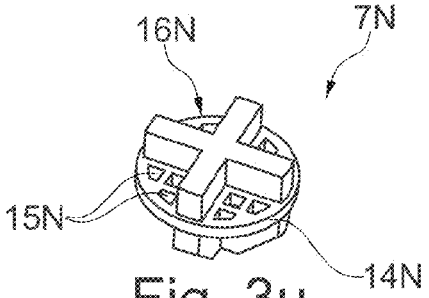
FIG. 3*u* illustrates an additional embodiment of an insert member.
Figure 3V:
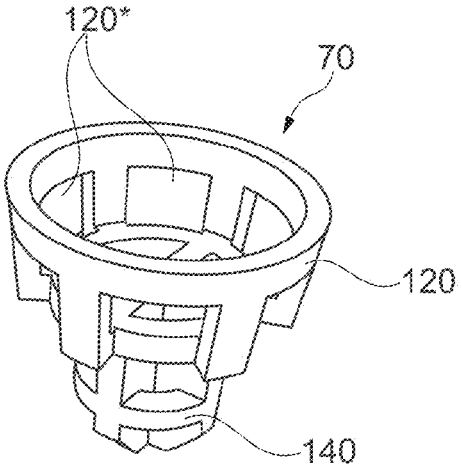
FIG. 3*v* illustrates an additional embodiment of an insert member.

FIGS. 3*a*-3*b* illustrate different views of the insert member 7B illustrated in FIG. 2*b*, whereas FIGS. 3*c*-3*v* illustrate alternative embodiment of an insert member 7C, 7D, 7E, . . . 7O.

To limit wax ingress through the insert member 7B, 7D, 7E, the insert part 8B, 8D, 8E comprises a retention member 14 for retention of wax, dirt, etc. The retention member 14 decreases the size of the void space inside the insert part 8B, 8D, 8E and thus hinder wax in getting though. In the illustrated embodiments, retention member 14 is arranged transverse to the longitudinal direction, at an angle of approximately 30 degrees relative to the longitudinal direction, as this will force the wax to travel through an indirect path through the insert part 8B, 8D, 8E, whereby the risk of soiling the inner space of the housing 2 is considerably decreased.

To improve the acoustic properties of the insert member 7B, 7C, 7D, 7E, the retention member 14 comprises a plurality of openings 15B, 15C, 15D, 15E transverse to the longitudinal direction. In the illustrated embodiments, the openings 15 are provided perpendicular to the longitudinal direction.

Additionally, the insert part 8D comprises two outwardly extending edges 16 configured to be arranged in contact with an inner surface of the sound channel 3. The outwardly extending edges facilitate retention of the insert part 8D in the sound channel 3, also function as a scraper which may remove wax located at the inner surface of the sound channel 3 during removal of the insert member, as the edges 16 can scrape against the inner surface during removal of the insert member 7D from the sound channel.

Additionally, the insert part 8E illustrated in FIG. 3*e* comprises an enclosure 8E* to retain wax. The enclosure 8E* is formed below the retention member 14E, i.e. at one side of the retention member 14E so that wax collected by the retention member 14E is retained in the enclosure 8E* partially formed by the retention member 14E.

The insert member 7F illustrated in FIG. 3*f* comprises a protruding engagement member 12F in the form of six protruding elements 12F extending outwardly to facilitate engagement with an uneven surface of a removal tool for removal of the insert member 7F without engaging the sound openings 11F. The retention member 14F is similar to the retention member 14 illustrated in FIG. 3*a*.

The insert member 7G illustrated in FIG. 3*f* comprises a protruding engagement member 12G similar to the protruding engagement member 12F illustrated in FIG. 3*f*. The retention member 14G comprises two parts being symmetrically arranged to form a V-shape. Additionally, the insert part 8G comprises an extending edge 16G configured to be arranged in contact with an inner surface of the sound channel 3. The outwardly extending edge facilitates retention of the insert part 8G in the sound channel 3.

The insert member 7H illustrated in FIG. 3*h* comprises a protruding engagement member 12H in the form of hook like element extending outwardly to facilitate engagement with an uneven surface of a removal tool for removal of the insert member 7H without engaging the sound openings 11H. The retention member 14H is similar to the retention member 14 illustrated in FIG. 3*a*. Additionally, the insert part 8H comprises an extending edge 16H configured to be arranged in contact with an inner surface of the sound channel 3. The outwardly extending edge facilitates retention of the insert part 8H in the sound channel 3, and functions as a scraper which may remove wax located at the inner surface of the sound channel 3 during removal of the insert member, as the edges 16H can scrape against the inner surface during removal of the insert member 7H from the sound channel.

The insert member 7I illustrated in FIG. 3*i* comprises an insert part 8I similar to the insert part 8G illustrated in FIG. 3*g*. The protruding engagement member 12I comprises two elements arranged opposite to each other to form a tunnel-like shape. Consequently, the insert member 7I may be removed by a removal tool engaging these elements instead of engaging the sound path.

The insert member 7J illustrated in FIGS. 3*j*, 3*k*, and 3*l* comprises an insert part 8J similar to the insert part 8G illustrated in FIG. 3*g* with the exception that the V-shape terminates in a part 8J* which is perpendicular to the longitudinal direction. The protruding engagement member 12J comprises two elements arranged opposite to each other to form a tunnel-like shape. The support part 9J comprises a plurality of indentation 9J* arranged along the outer surface of the flange part 9J. In FIG. 3*k*, the insert member 7J is inserted into a hearing aid 1 comprising a spout member 3, whereas the insert member 7J in FIG. 3*l* is inserted into a hearing aid 1 without a sport member.

The insert member 7K illustrated in FIGS. 3*m*-3*q* comprises a protruding engagement member 12K in the form of half-sphere element to facilitate engagement with an uneven surface of a removal tool for removal of the insert member 7K without engaging the sound path. The retention member 14K is in the illustrated embodiment arranged parallel to the longitudinal direction, and the openings 15K are perpendicular to the longitudinal direction. Additionally, the insert part 8K comprises an extending edge 16K configured to be engage an indentation formed in the inner surface of the sound channel 3, see FIG. 3*q*. The outwardly extending edge 16K facilitates retention of the insert part 8K in the sound channel 3 and thus forms a snap-fit locking of the insert member 7K.

In FIGS. 3*m*, 3*p*, and 3*q*, the insert member 7K is inserted into a hearing aid 1 comprising a spout member 3, whereas the insert member 7K in FIGS. 3*n* and 3*o* is inserted into a hearing aid 1 without a spout member. FIGS. 3*o*, 3*p*, and 3*q* illustrate cross-sections through the insert member 7K and the hearing aid 1.

The insert member 7L illustrated in FIG. 3*r* comprises protruding elements arranged opposite to each other to form a tunnel-like shape similar to the insert member of FIG. 3*i*. The retention member 14L is arranged parallel to the longitudinal direction, and the openings (not shown) are perpendicular to the longitudinal direction. Additionally, the insert part 8L comprises two extending edges 16L configured for retention of the insert member in the sound path by frictional forces.

The insert member 7M illustrated in FIG. 3*s* comprises a protruding element 12M comprising a hook-like extension. The retention member 14M comprise parts being arranged parallel to the longitudinal direction and parts being arranged perpendicular to the longitudinal direction to form a staircase-like part. Consequently, some of the opening 15M are perpendicular to the longitudinal direction, whereas other opening (not shown) are parallel to the longitudinal direction.

The insert member 7N illustrated in FIGS. 3*t* and 3*u* comprises a protruding engagement member 12N in the form of four protruding elements 12N extending outwardly to facilitate engagement with an uneven surface of a removal tool for removal of the insert member 7N without engaging the sound path. The retention member 14N is disc-shaped and is arranged perpendicular to the longitudinal direction. The opening 15N are parallel to the longitudinal direction. The outer edge of the disc-shaped retention member 14N forms an extending edge 16N configured to be arranged in contact with an inner surface of the sound channel 3. The outwardly extending edge facilitates retention of the insert part 8N in the sound channel 3, and further functions as a scraper which may remove wax located at the inner surface of the sound channel 3 during removal of the insert member, as the edge 16N can scrape against the inner surface during removal of the insert member 7N from the sound channel.

FIG. 3*u* is a cross-section through the insert member 7N of FIG. 3*t*.

The insert member 7O illustrated in FIG. 3*v* comprises a protruding engagement member 12O having a basket-like form and comprising a plurality of holes 12O* to facilitate engagement with an uneven surface of a removal tool for removal of the insert member 7O without engaging the sound path. The retention member 14O is disc-shaped and similar to the retention member 14N illustrated in FIGS. 3*t* and 3*u*. The opening are not shown in FIG. 3*v*.

Figure 4A:
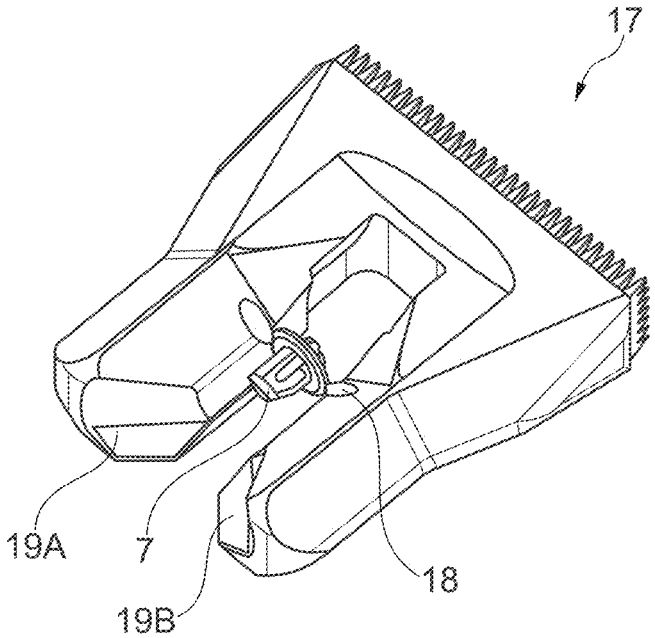
FIG. 4*a* illustrates an insertion tool and a removal tool.

FIG. 4*a* illustrates a combined insertion and removal tool 17 configured for insertion of an insert member 7 into a hearing aid 1 and configured for removal of an insert member 7 from a hearing aid 1.

The insertion tool 17 comprises a holding member 18 configured to retain the insert member 7 during alignment of the tool 17 and the hearing aid 1 and a guide 19 configured to engage an outer surface of the housing 2 to facilitate alignment of the insert member 7 and the sound channel 3.

The holding member 18 configured to retain the insert member 7 comprises breakable parts 20 (see FIG. 7 for details) to hold the insert member 7 in correct position during the insertion, and later release the insert member 7 when it has been inserted into the sound channel 3.

As the housing 2 is of a larger size than the sound channel 3, the insertion tool 17 assist the user when inserting the insert member 7, as the user may better control movement of the housing 2 with the aid of the insertion tool 17 comprising a guide 19 configured to engage an outer surface of the housing 2.

The guide 19 forms a funnel having a size which at the opening 21 (see FIG. 6) is larger than the housing 2 in order to pre-align the housing 2 with the insert member 7 retained in the insertion tool 17. At the opposite end 22 of the guide 19, the size of the funnel is smaller to fit the size and shape of an outer surface portion of the housing 2, thereby aligning the sound channel 3 with the insert member 7 which is retained in the insertion tool 17 at a position corresponding to the bottom 23 of the funnel, where the bottom 23 is oppositely arranged relative to the opening 21 of the funnel.

In the illustrated embodiment, the guide 19 comprises two tracks 19A, 19B facing each other and between which the housing 2 can be guided, as each of the tracks 19A, 19B having a shape matching a left and a right side of the housing 2, respectively.

Figure 4B:
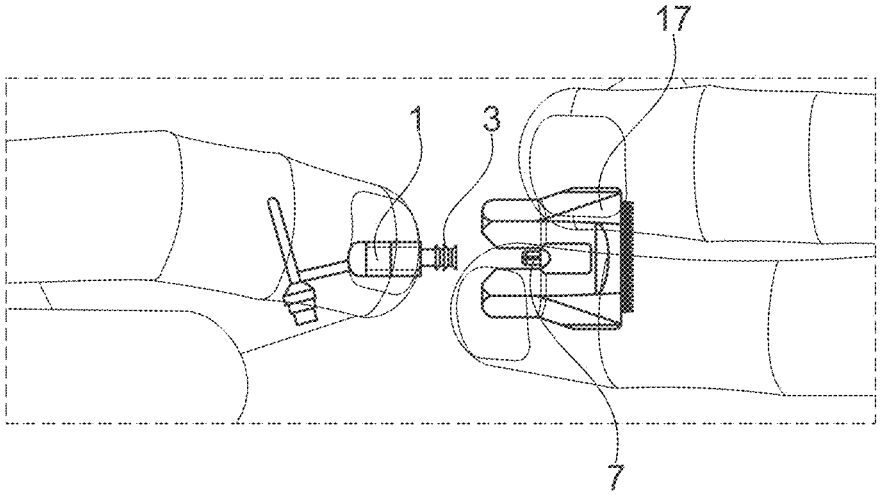
FIG. 4*b* illustrates insertion of an insert member into a hearing aid.

FIG. 4*b* illustrates the insertion of an insert member 7 into a hearing aid 1 by use of the combined tool 17.

Figure 5:
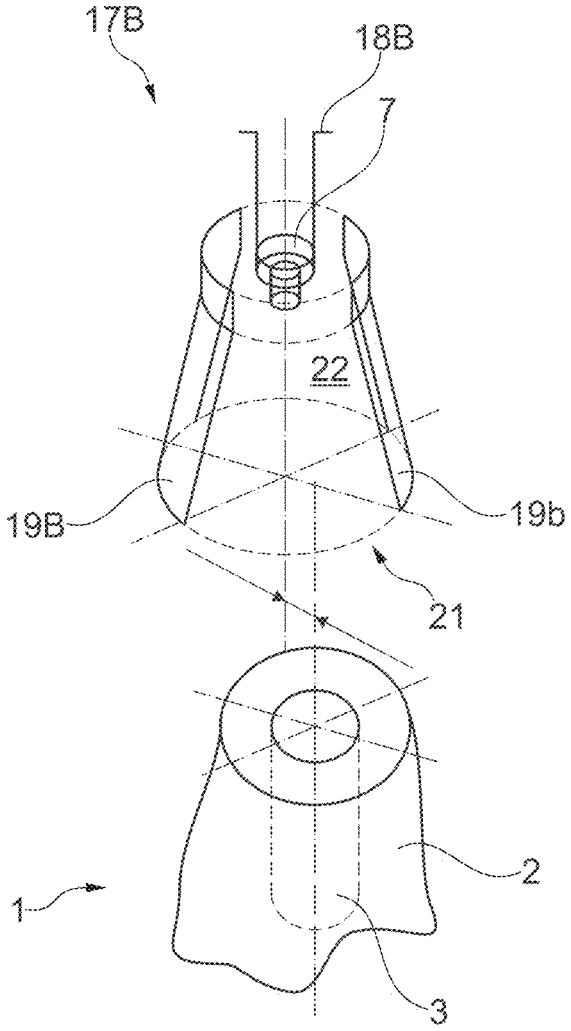
FIG. 5 illustrates an alternative embodiment of an insertion tool.

FIG. 5 illustrates an alternative embodiment of an insertion tool 17B. The insertion tool 17B comprises a holding member 18B configured to retain the insert member 7 during alignment of the tool 17B and the hearing aid 1 and a guide 19B configured to engage an outer surface of the housing 2 to facilitate alignment of the insert member 7 and the sound channel 3.

The guide 19B forms a funnel having a size which at the opening 21 is larger than the housing 2 in order to pre-align the housing 2 with the insert member 7 retained in the insertion tool 17B. At the opposite end 22 of the guide 19B, the size of the funnel is smaller to fit the size and shape of an outer surface portion of the housing 2, thereby aligning the sound channel 3 with the insert member 7 which is retained in the insertion tool 17B at a position corresponding to the bottom 23 of the funnel, where the bottom 23 is oppositely arranged relative to the opening 21 of the funnel.

Figure 6:
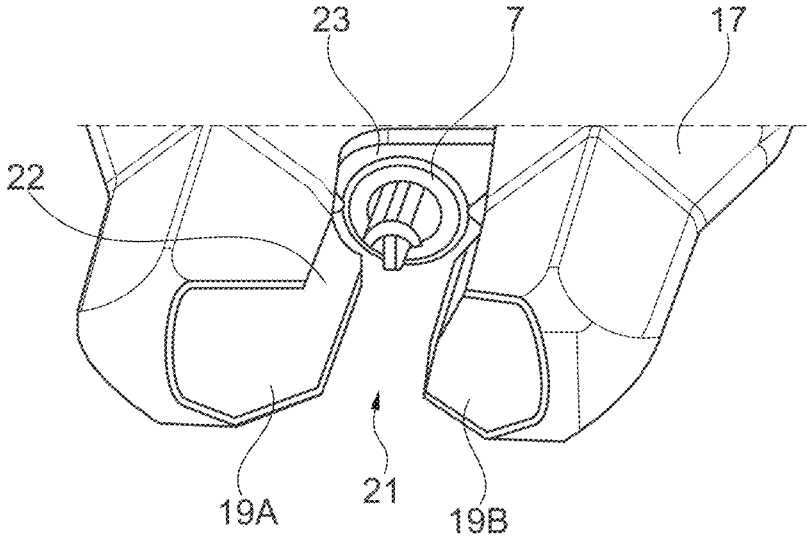
FIG. 6 illustrates details of a different embodiment of an insertion tool.
Figure 7:
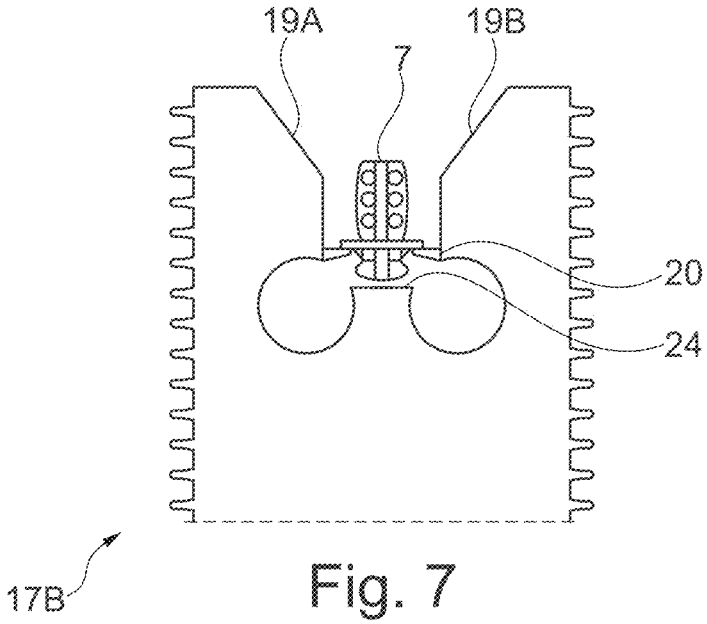
FIG. 7 illustrates details of a different embodiment of an insertion tool.

FIGS. 6 and 7 illustrate details of different embodiments of an insertion tool 17, 17B as described above. As illustrated in FIG. 7, the insertion tool 17B further comprises a stop member 24 which is configured to limit axial movement of the housing 2 relative to the insert tool 17B. The stop member 24 can give tactile guidance to the user indicating that the insert member 7 is correctly inserted, and can thus promote a safer and more complete insertion of the insert member 7.

Figure 8:
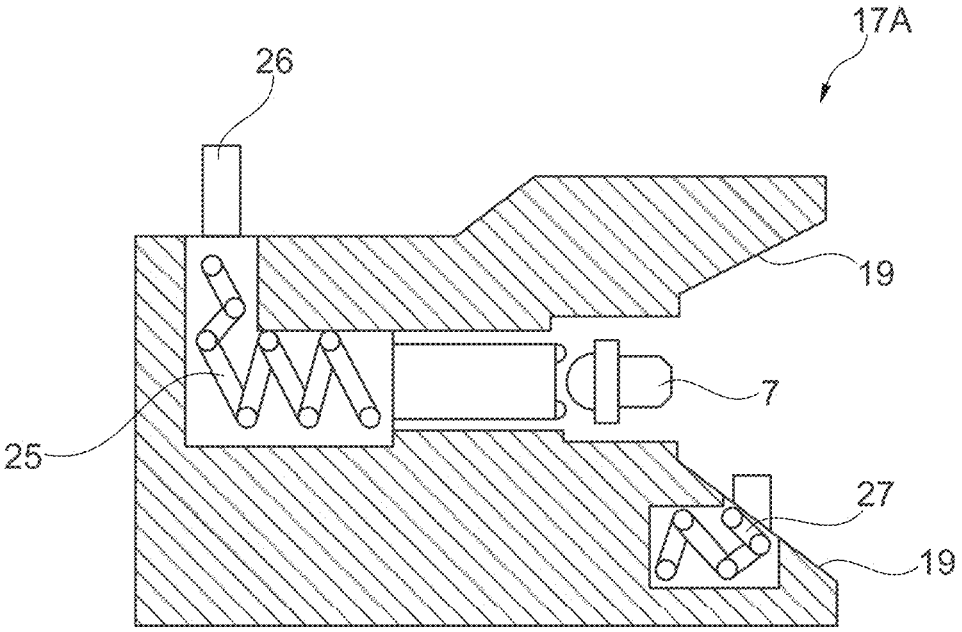
FIG. 8 illustrates an embodiment of an automatic insertion tool.

FIG. 8 illustrates an embodiment of an automatic insertion tool 17A according to the invention. The insertion tool 17A further comprises an actuating member 25 for automatic insertion of the insert member 7 by activation of the button 26.

To keep the housing 2 in place during insertion of the insert member 7, the insertion tool 17A further comprises a locking member 27 configured to fix the housing 2 to the insertion tool 17A during insertion of the insert member 7.

Figure 9:
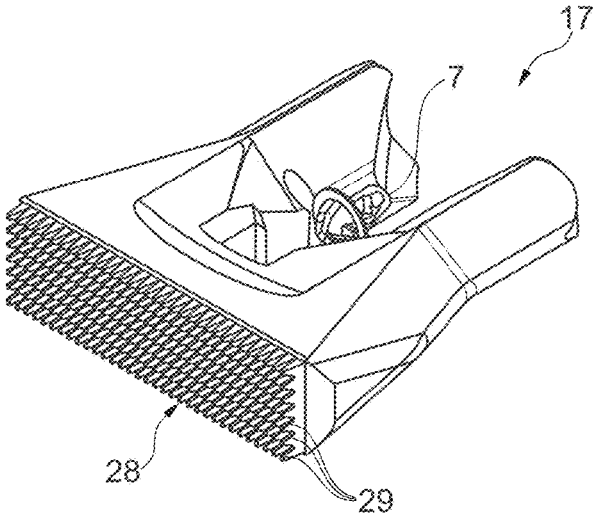
FIG. 9 illustrates an insertion tool and a removal tool.

FIG. 9 illustrates a combined insertion and removal tool 17 configured for insertion of an insert member 7 into a hearing aid 1 and configured for removal of an insert member 7 from a hearing aid 1.

The removal tool 17 comprises an engagement member 28 having an uneven surface configured to engage the protruding engagement member 12 whereby removal of the insert member 7 without engaging the sound path may be facilitated.

The uneven surface 28 is provided by a plurality of protrusions 29 being evenly arranged and thereby forming a brush-like surface.

Figure 10:
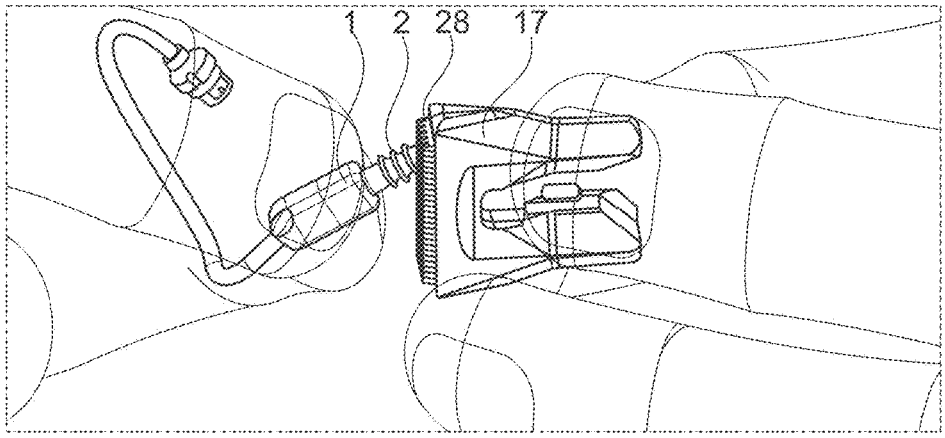
FIG. 10 illustrates removal of an insert member from a hearing aid.

As illustrated in FIG. 10, removal of the insert member 7 can be carried out at more positions and from more directions, as the uneven surface 28 may engage the protruding engagement member 12 under different angles and at different position at the surface, where the illustrated angle and position is one out of many.

The engagement member 28 comprising a plurality of protrusion 29 has the advantage that the removal may be carried out at more positions and form more directions, as the uneven surface may engage the protruding engagement member under different angles and at different position at the surface.

Figure 11A:
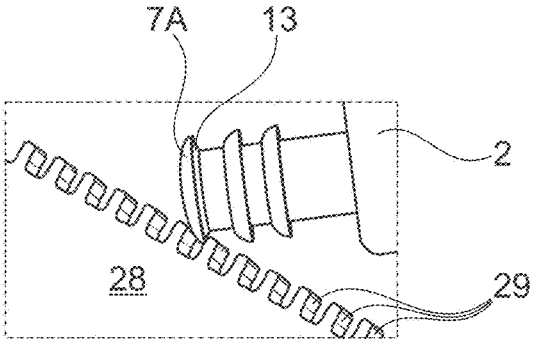
FIG. 11*a* illustrates removal of an insert member from a hearing aid.
Figure 11B:
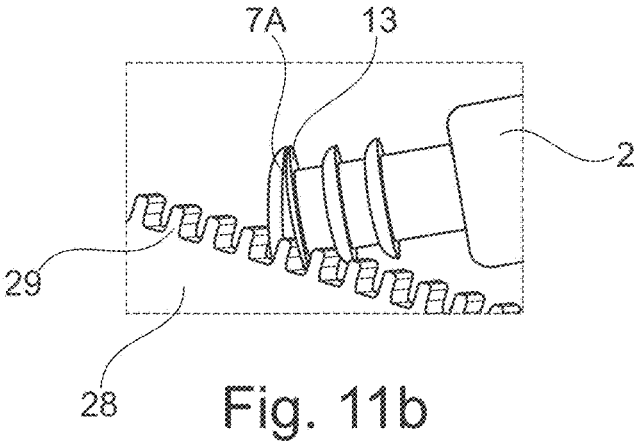
FIG. 11*b* illustrates removal of an insert member from a hearing aid.

One way of removing an insert member 7 is illustrated in FIGS. 11*a* and 11*b*. The protrusions 29 are made from a plastic material having a sufficient rigidity to engage the first flange 12A which has a radial dimension r1 being larger than the radial dimension r2 of the edge 13 (see FIGS. 1 and 2*a*), so that the first flange 12A extends beyond the circumference of the edge 13, whereby the insert member 7A can be removed by catching the first flange 12A instead of engaging the sound path.

Figure 11C:
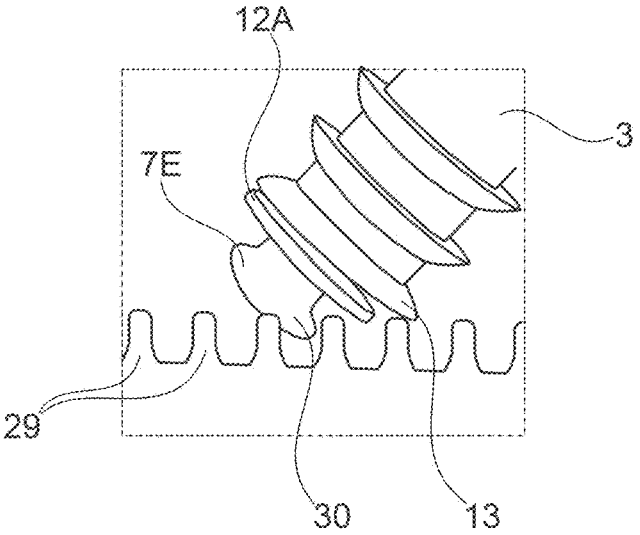
FIG. 11*c* illustrates removal of an insert member from a hearing aid.

FIG. 11*c* illustrates another removal process for removal of an insert member 7E from a hearing aid. The protrusions 29 are arranged at a distance corresponding to the distance between the first and second flange 12A, 30 of the insert member 7E to facilitate that one of the protrusions 29 is inserted in a space between the two flanges 12A, 30 to facilitate removal of an insert member 7E comprising two flanges.

Figure 12:
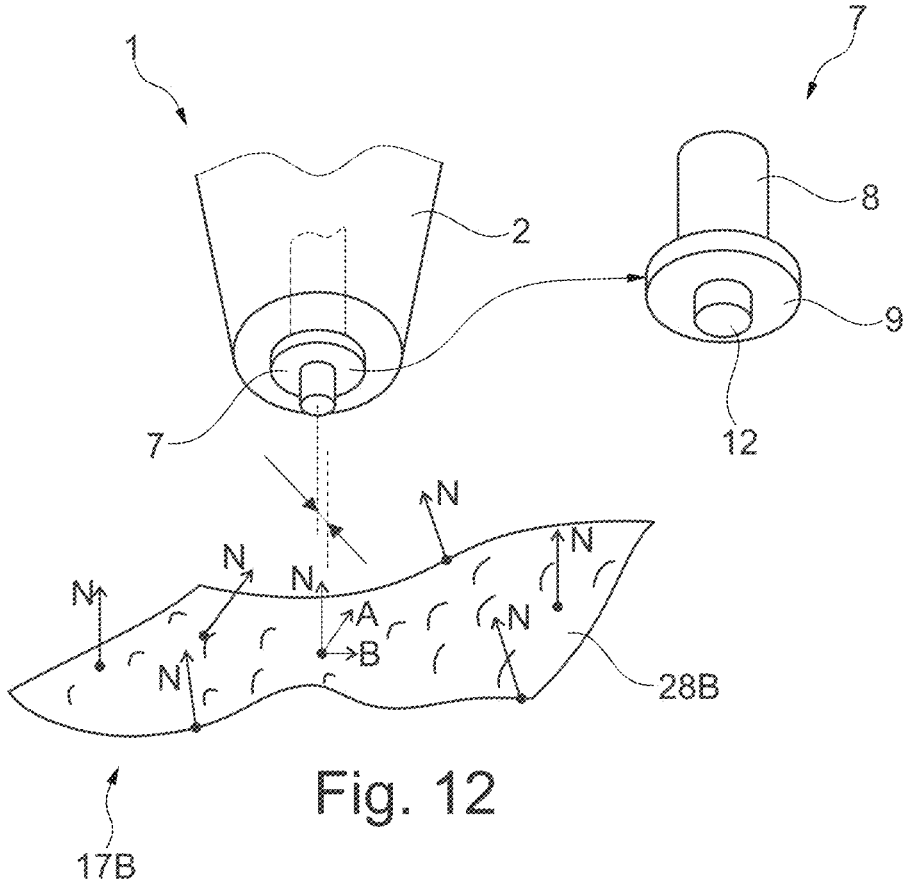
FIG. 12 illustrates removal of an insert member from a hearing aid.

FIG. 12 illustrates removal of an insert member 7 from a hearing aid 1. The removal tool 17 comprises an engagement member 28B having an uneven surface configured to engage the protruding engagement member 12B whereby removal of the insert member 7 without engaging the sound path may be facilitated.

The uneven surface 28B is provided by a plurality of protrusions illustrated by the arrows N each defining the normal to the surface 28B. The arrows A, B illustrate directions parallel to the surface.

Figure 13:
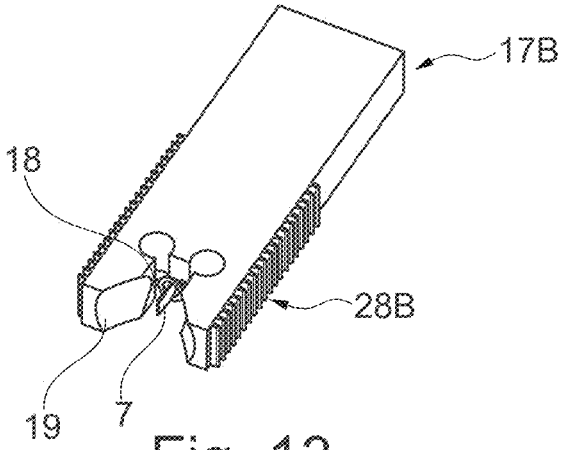
FIG. 13 illustrates a different embodiment of a removal tool.

FIG. 13 illustrates an alternative embodiment of a combined insertion and removal tool 17B, where the engagement member 28B having an uneven surface is arranged at the sides of the tool, instead as at an opposite end relative to the insertion tool part 18, 19.

Figure 14:
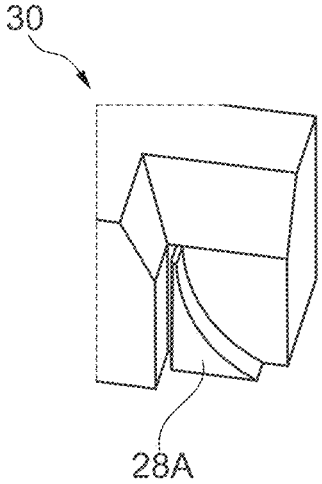
FIG. 14 illustrates a different embodiment of a removal tool.

FIG. 14 illustrates a section of another embodiment of a removal tool 30, where the engagement member 28 having an uneven surface is provided by a single wedge-like protrusion 29A configured to engage the protruding engagement member 12. The wedge-like protrusion 29A can engage both a protruding engagement member in the form of a first flange 12A and a protruding engagement member in the form of an arc-shaped elongated member 12B.

Figure 15:
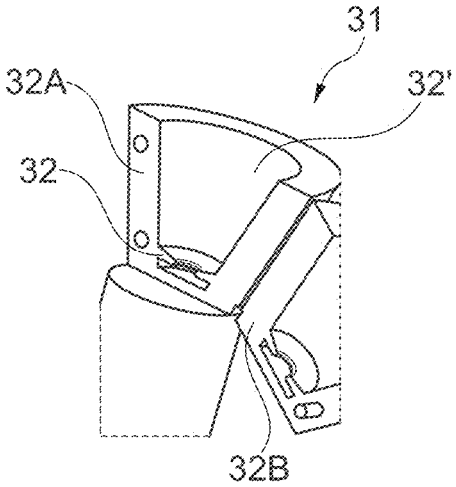
FIG. 15 illustrates a different embodiment of a removal tool.

FIG. 15 illustrates another embodiment of a removal tool 31 which comprises a mechanical locking member 32 in the form of a snap-fit locking which is configured to snap the protruding engagement member 12. The snap-fit locking 32 comprises two parts 32A, 32B being hingely connected to each other to facilitate moulding of the locking member 32. In a closed configuration the protruding engagement member 12 can be inserted into the locking part 32. The upper cone-shaped part 32' can be used to guide the protruding engagement member 12 into the snap-fit locking 32.

Figure 16A:
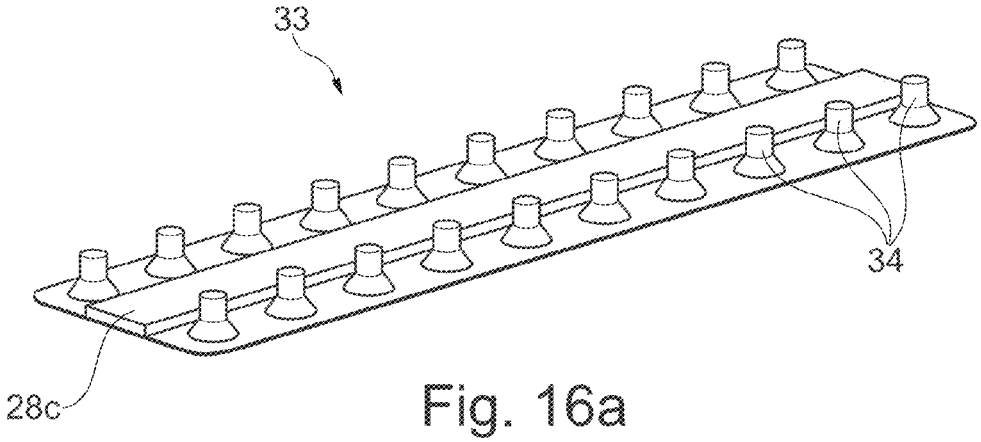
FIG. 16*a* illustrates details of a package for the insert member and an engagement member, including insertion and removal features.
Figure 16B:
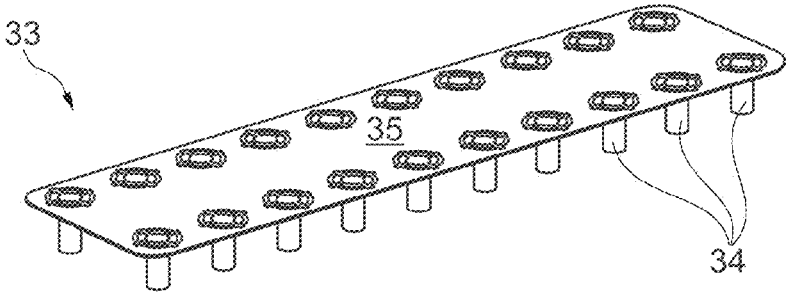
FIG. 16*b* illustrates details of the package for the insert member and an engagement member as shown in FIG. 16*a*, including insertion and removal features.
Figure 16C:
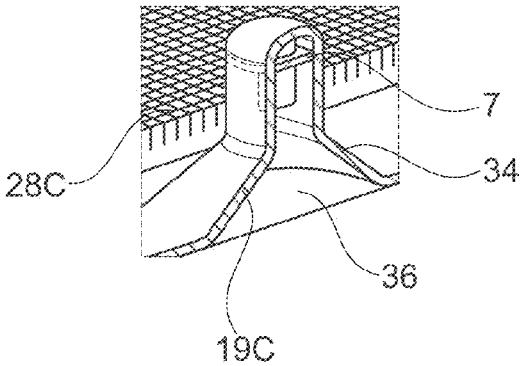
FIG. 16*c* illustrates an enlarged view of the package for the insert member and an engagement member of FIG. 16*a*, including insertion and removal features.

FIGS. 16*a*-16*c* illustrate details of a package 33 for the insert member 7 and an engagement member 28. Each of the protrusions 34 forms a compartment for an un-used insert member 7 which may be removed from the back side 35 of the package 33. In the middle part of the package 33, a compartment for a substitute engagement member 28C arranged. From the detailed view illustrated in FIG. 11*c* it can be seen, that the compartment 34 for un-used insert member is sealed by a foil 36. Furthermore, the compartment included a guide 19C for used during insertion of the insert member 7.

Figure 17A:
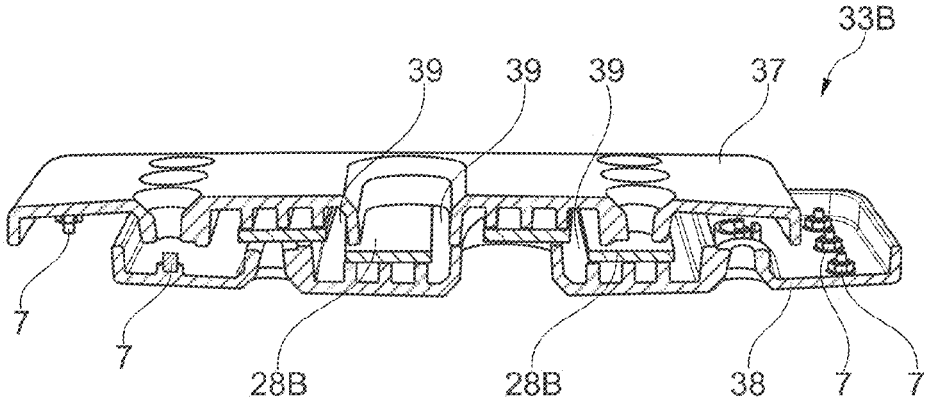
FIG. 17*a* illustrates details of an alternative embodiment of a package.
Figure 17B:
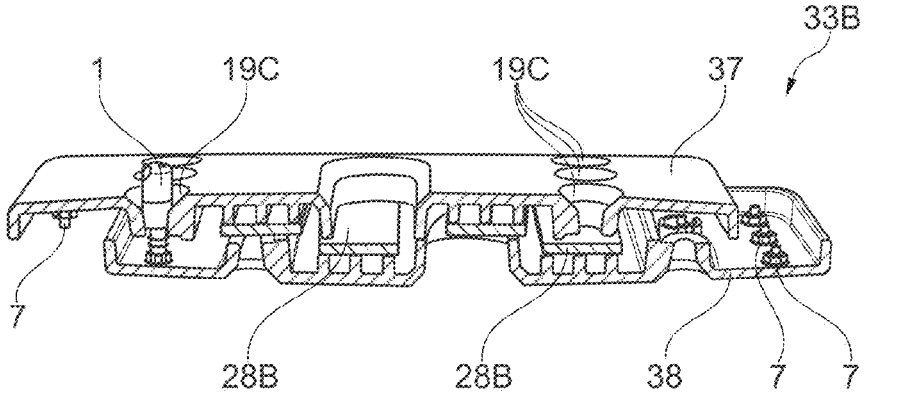
FIG. 17*b* illustrates details of the alternative embodiment of the package in FIG. 17*a*.

FIGS. 17*a*-17*b* illustrate details of an alternative embodiment of a package 33B which comprises a plurality of insert members 7. Access to the insert members 7 is provided by sliding the upper part 37 and the lower part 38 relative to each other. When sliding the upper and lower parts 37, 38 relative to each other, access is further provided to the a removal tool comprising an uneven surface 28B in the form of a fabric, whereby the package may also be used as a removal tool. When a used insert member 7 has been removed, it may stay in the package 33B as the compartments 39 may be used for collection of used insert members.

The package 33B may further be used as an insertion tool for insertion of the insert member 7 into a hearing aid 1. This is illustrated in FIG. 17B where a hearing aid 1 is arranged in one of the guides 19C formed as a funnel whereby an insert member 7 may be inserted into the hearing aid 1.

Figure 17C:
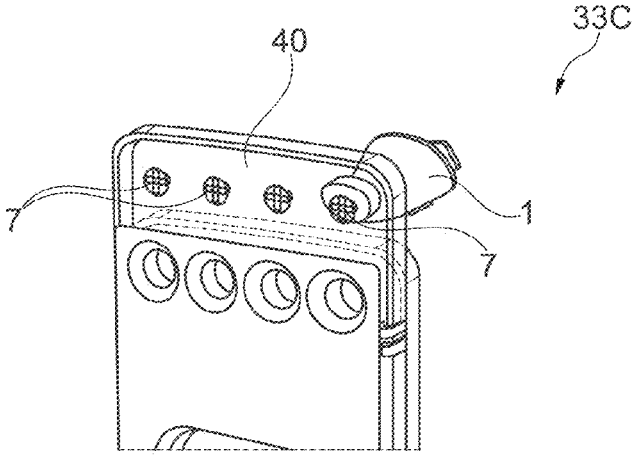
FIG. 17*c* illustrates details of an alternative embodiment of a package.

The package 33C illustrated in FIG. 17*c* comprises a translucent part 40 to facilitate engagement between the hearing aid 1 and the insert member 7, when the package 33C is used as an insertion tool. Thereby a user can look through at least a part of the package when wanting to catch a new insert member 7. As the hearing aid itself may hinder the view to the insert member 7 when inserting the insert member 7 into the hearing aid this may facilitate engagement.

Figure 18A:
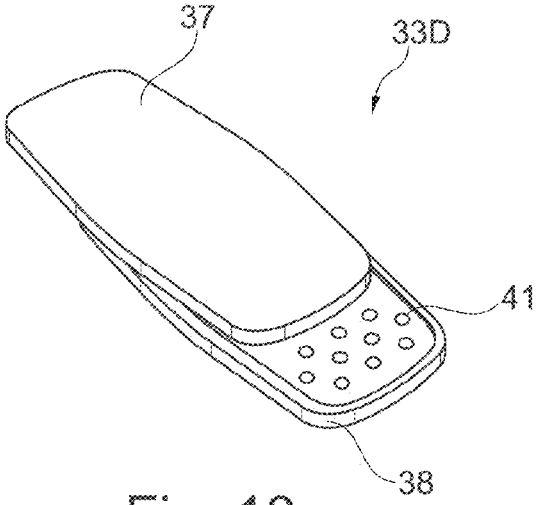
FIG. 18*a* illustrates details of a further alternative embodiment of a package.
Figure 18B:
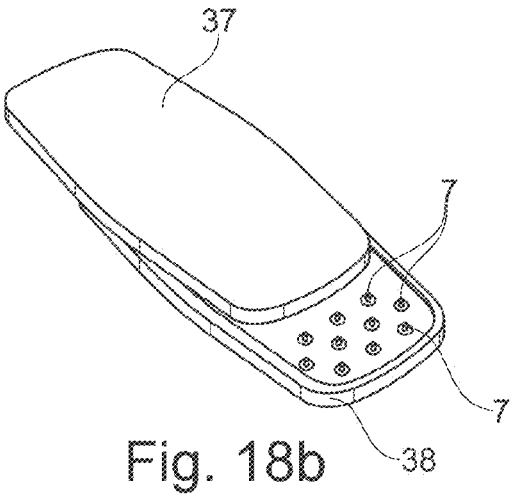
FIG. 18*b* illustrates details of the further alternative embodiment of the package in FIG. 18*a*.
Figure 18C:
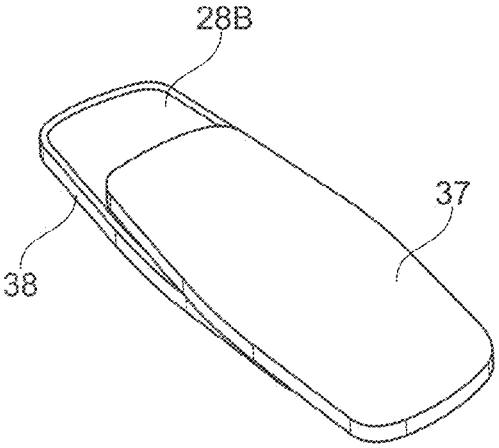
FIG. 18*c* illustrates details of the further alternative embodiment of the package in FIG. 18*a*.

FIGS. 18*a*-18*c* illustrate details of a further alternative embodiment of a package 33D. Access to the insert members 7 is provided by sliding the upper part 37 and the lower part 38 relative to each other. When sliding the upper and lower parts 37, 38 relative to each other, access is further provided to the a removal tool comprising an uneven surface 28B in the form of a fabric, whereby the package may also be used as a removal tool. The openings 41 illustrated in FIG. 18*a* are for insert members as illustrated in FIG. 18*b*.

The invention claimed is:

1. A hearing aid comprising:

a housing for positioning in or at an ear canal of a user, the housing having a sound channel extending in a longitudinal direction and terminating in a sound opening;

a transducer located in the housing and configured for transducing sound at the sound opening; and an insert member comprising an insert part for insertion into the sound channel and a support part for arrangement against the housing, the insert member forming a sound path from a first sound opening to a second sound opening, the first sound opening being arranged in the insert part and the second sound opening being arranged in the support part outside the sound channel;

wherein the insert part comprises a retention member for retention of wax, the retention member comprising at least one opening and being arranged so that at least a part hereof extends transverse to the longitudinal direction, and wherein the support part forms a protruding engagement member which facilitates catching of the insert member without engaging the sound path during removal of the insert member.

2. A hearing aid according to claim 1, wherein the protruding engagement member forms a first flange extending radially outwardly for arrangement against the housing.

3. A hearing aid according to claim 1, wherein the sound channel is formed in an elongated member extending outwardly form the housing, and wherein the protruding engagement member is formed by the support part having a radial dimension being larger than a radial dimension at an outer end of the elongated member.

4. A hearing aid according to claim 1, wherein the protruding engagement member is formed as an extension to the support part.

5. A hearing aid according to claim 1, wherein the sound channel defines a centre axis extending in a longitudinal direction between the housing and the sound opening, and wherein a first radial dimension of the housing relative to the centre axis, and a second radial dimension of the sound channel relative to the centre axis facilitates arrangement of the sound channel and the housing against a plane surface such that an angle of the centre axis to the plane surface is below 60 degrees.

6. A hearing aid according to claim 1, wherein the insert part is configured to be retained in the sound channel by friction between an outer surface of the insert part and an inner surface of the sound channel.

7. A hearing aid according to claim 1, wherein an outer circumference of the insert member is substantially symmetrically in the longitudinal direction.

8. A hearing aid according to claim 1, wherein the sound channel has a length in the longitudinal direction in the range of 0.5-80 mm.

9. A hearing aid according to claim 1, wherein the sound channel comprises a radially outwardly extending edge forming an outer end.

10. A hearing aid according to claim 1, wherein the insert member comprises a second flange extending radially outwardly.

11. A hearing aid according to claim 1, wherein the at least one opening in the retention member is transverse to the longitudinal direction.

12. A hearing aid according to claim 1, wherein the retention member comprises at least one of a membrane and a retention part made from a porous material.

13. A hearing aid according to claim 1, further comprising an enclosure to retain wax.

14. A hearing aid according to claim 1, wherein the retention member is substantially disc-shaped and is arranged substantially perpendicular to the longitudinal direction.

15. A hearing aid according to claim 1, wherein the retention member comprises at least two parts being symmetrically arranged in the insert member.

16. A hearing aid according to claim 15, wherein the symmetrically arranged parts are parallel along at least a part hereof.

17. A hearing aid according to claim 1, wherein the insert part comprises at least one outwardly extending edge configured to be arranged in contact with an inner surface of the sound channel.

18. A hearing aid according to claim 1, further comprising a connector housing configured to be connected to a behind-the-ear part of the hearing aid, and an elongated tube configured for transfer of a signal from the connector housing to the housing, wherein the housing and the connector housing are attached to opposite ends of the elongated tube.

19. An insert member for insertion into a sound channel of a hearing aid, the insert member comprising:

an insert part for insertion into the sound channel; and a support part for arrangement against an outer surface of the hearing aid, the insert member forming a sound path from a first sound opening to a second sound opening, the first sound opening being arranged in the insert part and the second sound opening being arranged in the support part outside the sound channel, and wherein the insert part comprises a retention member for retention of wax, the retention member comprising at least one opening, and wherein the support part forms an engagement member which facilitates catching of the insert member without engaging the sound path during removal of the insert member from the hearing aid.

* * * * *